US007539445B2

(12) United States Patent
Sasae et al.

(10) Patent No.: US 7,539,445 B2
(45) Date of Patent: May 26, 2009

(54) DEVELOPER SUPPLY CONTAINER AND IMAGE FORMING APPARATUS

(75) Inventors: Kazuyoshi Sasae, Toride (JP); Nobuo Nakajima, Kashiwa (JP); Fumio Tazawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/051,143

(22) Filed: Mar. 19, 2008

(65) Prior Publication Data

US 2008/0213004 A1 Sep. 4, 2008

Related U.S. Application Data

(62) Division of application No. 11/270,601, filed on Nov. 10, 2005, now Pat. No. 7,369,798.

(30) Foreign Application Priority Data

Nov. 12, 2004 (JP) ..... 2004-328681

(51) Int. Cl.
*G03G 15/08* (2006.01)

(52) U.S. Cl. ..... 399/258; 399/260

(58) Field of Classification Search ..... 399/258, 399/260, 262

See application file for complete search history.

(56) References Cited

U.S. PATENT DOCUMENTS

| | | | |
|---|---|---|---|
| 6,289,193 | B1 | 9/2001 | Ban et al. |
| 6,292,644 | B1 | 9/2001 | Goto et al. |
| 6,314,261 | B1 | 11/2001 | Omata et al. |
| 6,438,345 | B1 | 8/2002 | Ban et al. |
| 6,766,133 | B1 | 7/2004 | Ban et al. |
| 6,934,494 | B2 | 8/2005 | Yamada et al. |
| 6,944,417 | B2 | 9/2005 | Yamada et al. |
| 6,947,690 | B2 | 9/2005 | Tazawa et al. |

(Continued)

FOREIGN PATENT DOCUMENTS

| | | |
|---|---|---|
| EP | 0 989 472 A2 | 3/2000 |

(Continued)

OTHER PUBLICATIONS

European Search Report issued in EP 07100972.4-2209 on Apr. 16, 2007.

*Primary Examiner*—William J Royer
(74) *Attorney, Agent, or Firm*—Fitzpatrick, Cella, Harper & Scinto

(57) ABSTRACT

A developer supply container detachably mountable to a main assembly of an image forming apparatus includes a developer discharge opening to be disposed opposite to a developer receiving opening of the apparatus main assembly; an operation member capable of performing a moving operation in a mounted state of the container; an open/close driving force transmitting portion provided to the operation member; a driving force transmitting portion for transmitting a driving force, to a apparatus shutter member, from the open/close driving force transmitting portion through an open/close driving force relay gear train provided to the apparatus main assembly; and a container-side abutting portion for abutting against a gear-side abutting portion provided to at least one gear of the relay gear train. When the developer supply container is mounted into the apparatus main assembly, the container-side abutting portion abuts against the gear-side abutting portion to rotate the relay gear train toward an initial position.

11 Claims, 19 Drawing Sheets

U.S. PATENT DOCUMENTS

| | | | |
|---|---|---|---|
| 7,039,347 | B2 | 5/2006 | Yamada et al. |
| 7,079,788 | B2 | 7/2006 | Ban et al. |
| 2004/0131391 | A1 | 7/2004 | Nagashiro |
| 2004/0161266 | A1 | 8/2004 | Ban et al. |
| 2005/0008400 | A1 | 1/2005 | Tazawa et al. |
| 2005/0135841 | A1 | 6/2005 | Murakami et al. |
| 2005/0169672 | A1 | 8/2005 | Ban et al. |
| 2006/0051107 | A1 | 3/2006 | Fujiwara et al. |

FOREIGN PATENT DOCUMENTS

| | | | |
|---|---|---|---|
| JP | 5-341584 | | 12/1993 |
| JP | 2000-162861 | A | 6/2000 |
| WO | WO/2006/052005 | A2 | 5/2006 |

(a)

(b)

DEVELOPER SUPPLY CONTAINER AND IMAGE FORMING APPARATUS

This application is a division of U.S. patent application Ser. No. 11/270,601, filed Nov. 10, 2005.

FIELD OF THE INVENTION AND RELATED ART

The present invention relates to a developer supply container for supplying a powdery developer to an electrophotographic image forming apparatus for forming an image with the developer, and the image forming apparatus using the developer supply container.

Here, the electrophotographic image forming apparatus is an image forming apparatus for forming an image on a recording medium in accordance with an electrophotographic image forming method. Examples of the electrophotographic image forming apparatus may include an electrophotographic copying machine, electrophotographic printers (such as a laser beam printer and an LED printer), a facsimile apparatus, a word processor, etc.

In the image forming apparatus such as the electrophotographic copying machine, the laser beam printer, etc., a latent image is formed by selectively exposing an electrically uniformly charged surface of a photosensitive drum to light and is developed with a developer to form a developer image. Then, the developer image is transferred onto a recording medium to effect image recording. In such an image forming apparatus, the developer is required to be supplied every time the developer is used up. Here, a developer supply container for supplying the developer to the image forming apparatus is roughly classified into a so-called simultaneous supply-type developer supply container which supplies the whole amount of developer contained in the developer supply container to a developer receiving container of a main assembly of the image forming apparatus at the same time and a stationary-type developer supply container which is mounted into the image forming apparatus main assembly, left standing as it is, and gradually supplies the developer to a developing apparatus until the developer is used up.

Particularly, in recent years, from the viewpoints of contamination during supply of the developer and operability, many proposals for the latter stationary-type developer supply container have been made. In the case where a developer in an image forming apparatus is consumed, a developer supply container (hereinafter also referred to as a "toner cartridge") is replaced by demounting it from the image forming apparatus and mounting a new one into the image forming apparatus, so that (fresh) toner is supplied to the image forming apparatus.

The toner as the developer is very fine powder, so that there has arisen such a problem that the toner scatters from a minute spacing between constitutional parts due to operational vibrations or the like during a toner supply operation, thus contaminating a user or surrounding parts with the toner. For this reason, such a method that a developer supply container is mounted inside a main assembly of image forming apparatus and toner is discharged little by little from a small opening has been proposed and put into practical use. In such a method, it is difficult to discharge the toner naturally by the action of gravity or the like, so that the image forming apparatus is generally provided with any toner stirring conveyance means.

Further, below the toner cartridge (developer supply container), the image forming apparatus is provided with a buffer portion, as a toner containing portion, for temporarily storing the toner. Inside the buffer portion, a metering screw for stirring the toner and feeding a predetermined amount of toner corresponding to a degree of rotation and a conveyance screw, disposed downstream from the metering screw, for conveying the toner by being rotated always during recording (image formation) are disposed so as to supply a necessary amount of toner to a process cartridge.

In the case where all the amounts of toner in the toner cartridge are discharged into the buffer portion to empty the toner cartridge in the above described image forming apparatus, the image forming apparatus detects that the toner cartridge is empty and provides notification, to a user, that the developer supply container should be replaced with new one. In accordance with this notification, the user removes the (old) empty developer supply container from the image forming apparatus and inserts a new developer supply container into the image forming apparatus in place of the empty developer supply container, so that the image forming apparatus is capable of further continuing an image forming operation.

Japanese Laid-Open Patent Application No. 2000-162861 has disclosed, as an example of a conventional developer supply container, such a constitution that a shutter of a developer supply container is opened and closed through a rotational force transmission member provided in a main assembly of an image forming apparatus, as shown in FIGS. 16 and 17.

Referring to FIG. 16, an image forming apparatus is provided with an open/close portion 501 at a side surface of a main assembly 500 of the image forming apparatus, so that a developer supply container (toner cartridge) 600 is mounted and demounted from the side surface of the image forming apparatus. The toner cartridge 600 has, as shown in FIG. 16(*a*), a developer discharge opening 601 (FIG. 18) sealed or covered with a container shutter 602. The container shutter 602 is constituted so that it is not readily opened even when a user rotationally moves it in a simple one direction outside the main assembly, thus preventing toner from contaminating surrounding parts or portions due to erroneous leakage.

Further, as shown in FIG. 17(*b*), when the toner cartridge 600 is mounted into the main assembly 500 of the image forming apparatus, a driving force is transmitted from a driving force transmission portion 603*a* of a knob 603 provided to the toner cartridge 600 to a driving force receiving portion 602*a* of the container shutter 602 through a driving force relay portion 502 provided to the apparatus main assembly by rotationally driving the knob 603 of the toner cartridge 600, so that the container shutter 602 is moved apart from a toner discharge opening. Incidentally, in FIGS. 17(*a*) and 17(*b*), the toner cartridge 600 is depicted upside down for convenience of explanation. Accordingly, during actual mounting of the toner cartridge 600, an upper surface of the toner cartridge 600 shown in these figures is located at a lower surface thereof in the actual mounted state.

Further, as shown in FIG. 18, a buffer portion 503 of the apparatus main assembly 500 is provided with a developer receiving opening 504 opposite to the developer discharge opening 601, which is provided with an apparatus shutter 505 for preventing contamination when the toner cartridge 600 is not mounted. The container shutter 602 and the apparatus shutter 505 are engaged with each other by mounting the toner cartridge 600 into the main assembly 500 to perform an open/close operation in an integrated state.

Demands for a further reduction in mounting space of the main assembly of image forming apparatus and an improvement in operability have been still increased, so that arrangement of consumable articles such as the developer supply container (toner cartridge) and a removal direction of the developer supply container are of increasing importance. For the reduction in mounting space, it is effective to set the removal direction of the consumable article and an access direction into the main assembly such as a housing open/close direction during clearance of paper jam as uniform as possible. As a result, the apparatus main assembly is provided with a side surface free from an open/close door, so that there is no need to ensure a space for opening and closing the door at the side surface at the time of mounting the image forming apparatus, thus being very effective for space saving. Further, a single function printer having no image reading mechanism is improved in operability by setting the consumable article removal direction as an upward direction of the main assembly since the image reading mechanism covering an upper portion of the image forming apparatus is not employed.

In view of this point, e.g., as shown in FIG. 2(*b*), it can be considered that an image forming apparatus is provided with a toner cartridge cover 23 at an upper surface thereof and a toner cartridge 31 is mounted from above the image forming apparatus. With respect to the toner cartridge 31, it can be considered that an unshown container shutter and an unshown apparatus shutter are opened and closed by rotationally driving a handle 36 in place of the knob 603.

Incidentally, in the above described constitution, it is assumed that gears are used as a driving force relay portion for transmitting a driving force from the handle 36 to the container shutter or the apparatus shutter. In the case where a gear train (stepped gears) comprising a plurality of gears which have a common rotational axis and are different in number of teeth used, an overlapping manner as seen in a rotational axis direction is different. For this reason, in such a constitution that other gears are mounted to and demounted from both ends of the gear train in order to relay the driving force as described above, depending on a state of the gear train, deviation in positional relationship (phase) between a handle and a shutter connected to the both ends of the gear train is caused to occur.

For example, in an initial state of a stepped gear shown in FIG. 19(*a*), teeth a1 of a gear 506*a* and teeth b1 of a gear 506*b* have the same phase. However, as shown in FIG. 19(*b*), in a state wherein the stepped gear is rotated at a predetermined angle, teeth a4 of the gear 506*a* and teeth b4 of the gear 506*b* are 9.6 degrees out of phase with each other. Accordingly, a handle and a shutter member connected through the gear train including this stepped gear also cause phase difference therebetween. As a result, an opening and closing (open/close) operation of the shutter member is out of a range which is originally intended.

From the viewpoint of size reduction of the image forming apparatus, when a plurality of toner cartridges are disposed tightly without leaving space, a rotational movement range of the handle 36 is restricted so as not to interfere with an adjacent toner cartridge. In such a restricted condition of the rotational movement range, when the above described phase difference is caused to occur, there are possibilities that the apparatus shutter is not sufficiently closed by the restricted rotational movement and that the apparatus shutter runs against an opposite closing position before the handle is rotationally moved in a predetermined amount of rotation, so that the handle cannot be rotationally moved to prevent the toner cartridge from being removed from the main assembly of the image forming apparatus. Further, with repetition of mounting and demounting to an open direction, so that there is also a possibility that the developer receiving opening of the image forming apparatus main assembly remains open.

SUMMARY OF THE INVENTION

An object of the present invention is to provide a developer supply container, detachably mountable to an main assembly of an image forming apparatus, capable of preventing a first driving force transmitting portion for opening and closing a developer discharge opening and a second driving force transmitting portion, which are connected via a driving force relay portion provided to the image forming apparatus main assembly, from deviating from a predetermined position to be engaged with a gear of the main assembly.

Another object of the present invention is to provide an image forming apparatus to which the developer supply container is detachably mountable.

According to an aspect of the present invention, there is provided a developer supply container capable of supplying a developer to a portion, to be supplied with the developer, of a main assembly of an image forming apparatus by being mounted into the image forming apparatus main assembly to permit transmission of a driving force between the developer supply container and the image forming apparatus main assembly, the developer supply container comprising:

a developer discharge opening to be disposed opposite to a developer receiving opening provided to the image forming apparatus main assembly when the developer supply container is mounted into the image forming apparatus main assembly;

an operation member capable of performing a moving operation in a mounted state of the developer supply container;

a first transmitting portion, provided to the operation member, for transmitting a driving force for opening and closing the developer discharge opening;

a second transmitting portion for transmitting a driving force to a main assembly shutter member, provided to the image forming apparatus main assembly, for opening and closing the developer receiving opening; the driving force having been transmitted from the first transmitting portion when the developer supply container is mounted into the image forming apparatus main assembly through a relay gear train, for opening and closing the developer receiving opening, provided to the image forming apparatus main assembly and provided with at least a plurality of gears which have a common rotational axis and are different in number of teeth; and a container-side abutting portion for abutting against a gear-side abutting portion provided to at least one gear of the relay gear train;

wherein the container-side abutting portion abuts against the gear-side abutting portion to rotate the relay gear train when the developer supply container is mounted into the image forming apparatus main assembly.

According to another aspect of the present invention, there is provided an image forming apparatus, to which a developer supply container is detachably mountable, capable of supplying a developer to a portion to be supplied with the developer of a main assembly of the image forming apparatus by performing transmission of a driving force between a mounted developer supply container and the main assembly of the image forming apparatus, the image forming apparatus comprising:

a developer receiving opening to be disposed opposite to a developer discharge opening of the mounted developer supply container;

a relay gear train for receiving a driving force from a first transmitting portion, provided to an operation member of the mounted developer supply container for transmitting the driving force for opening and closing the developer supply opening, and for transmitting the driving force to a second transmitting portion, provided to the developer supply container, for transmitting the driving force; and an apparatus shutter member for receiving the driving force from the second transmitting portion to open and close the developer receiving opening;

wherein the relay gear train comprises at least a plurality of gears which have a common rotational axis and are different in number of tooth;

wherein one of the gears of the relay gear train is provided with a gear-side abutting portion for abutting against a container-side abutting portion provided to the developer supply container when the developer supply container is mounted into the image forming apparatus main assembly; and wherein the container-side abutting portion abuts against the gear-side abutting portion to rotate the relay gear train when the developer supply container is mounted into the image forming apparatus main assembly.

According to a further aspect of the present invention, there is provided an image forming apparatus, to which a developer supply container is detachably mountable, capable of supplying a developer to a portion to be supplied with the developer of a main assembly of the image forming apparatus by performing transmission of a driving force between a mounted developer supply container and the main assembly of the image forming apparatus, the image forming apparatus comprising:

a developer receiving opening to be disposed opposite to a developer discharge opening of the mounted developer supply container;

a relay gear train for receiving a driving force from a first transmitting portion, provided to an operation member of the mounted developer supply container for transmitting the driving force for opening and closing the developer supply opening, and for transmitting the driving force to a second transmitting portion, provided to the developer supply container, for transmitting the driving force; and an apparatus shutter member for receiving the driving force from the second transmitting portion to open and close the developer receiving opening;

wherein the relay gear train comprises at least a plurality of gears which have a common rotational axis and are different in number of tooth; and wherein the image forming apparatus further comprises a gear return mechanism for returning the plurality of gears to their initial positions in a state in which the developer supply container is not mounted into the image forming apparatus main assembly.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiments of a developer supply container and an image forming apparatus according to the present invention will be described with reference to the drawings.

(General Structure)

Figure 1:
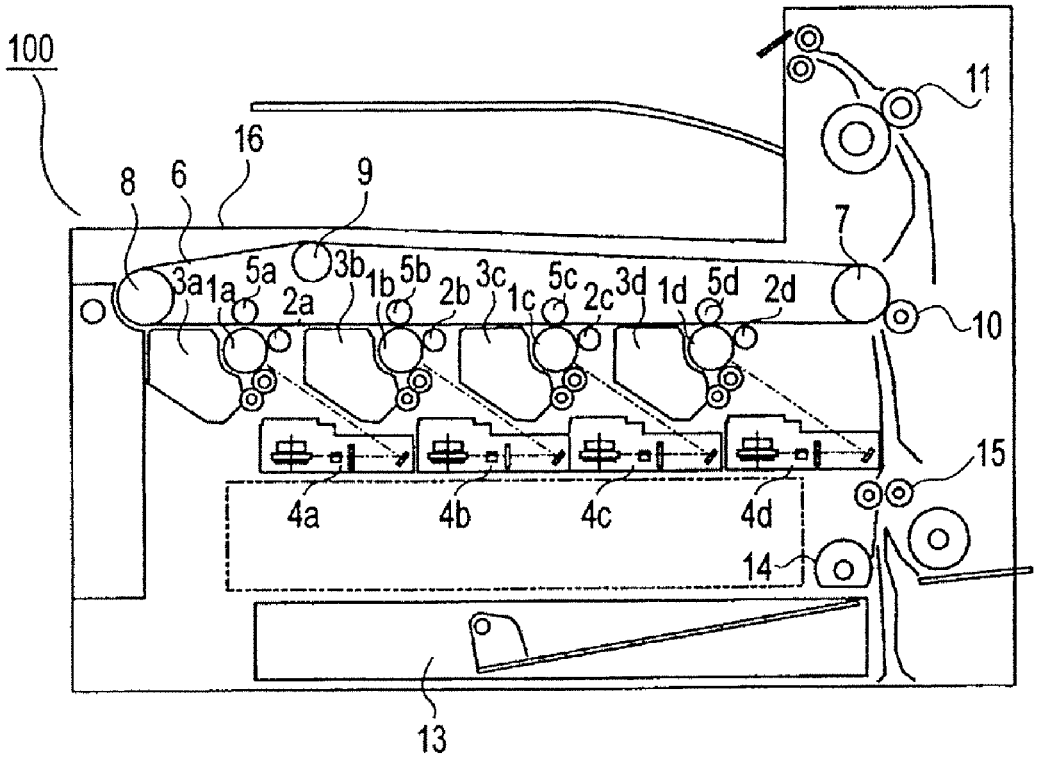
FIGS. 1(*a*) and 1(*b*) are schematic explanatory views of a main assembly of an image forming apparatus.
Figure 1:
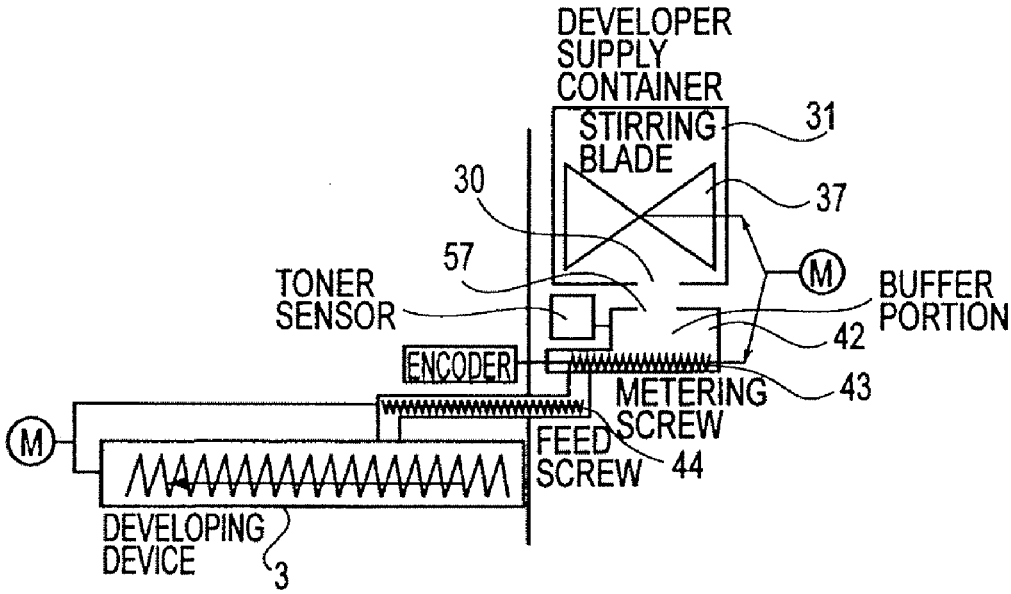
Figure 2:
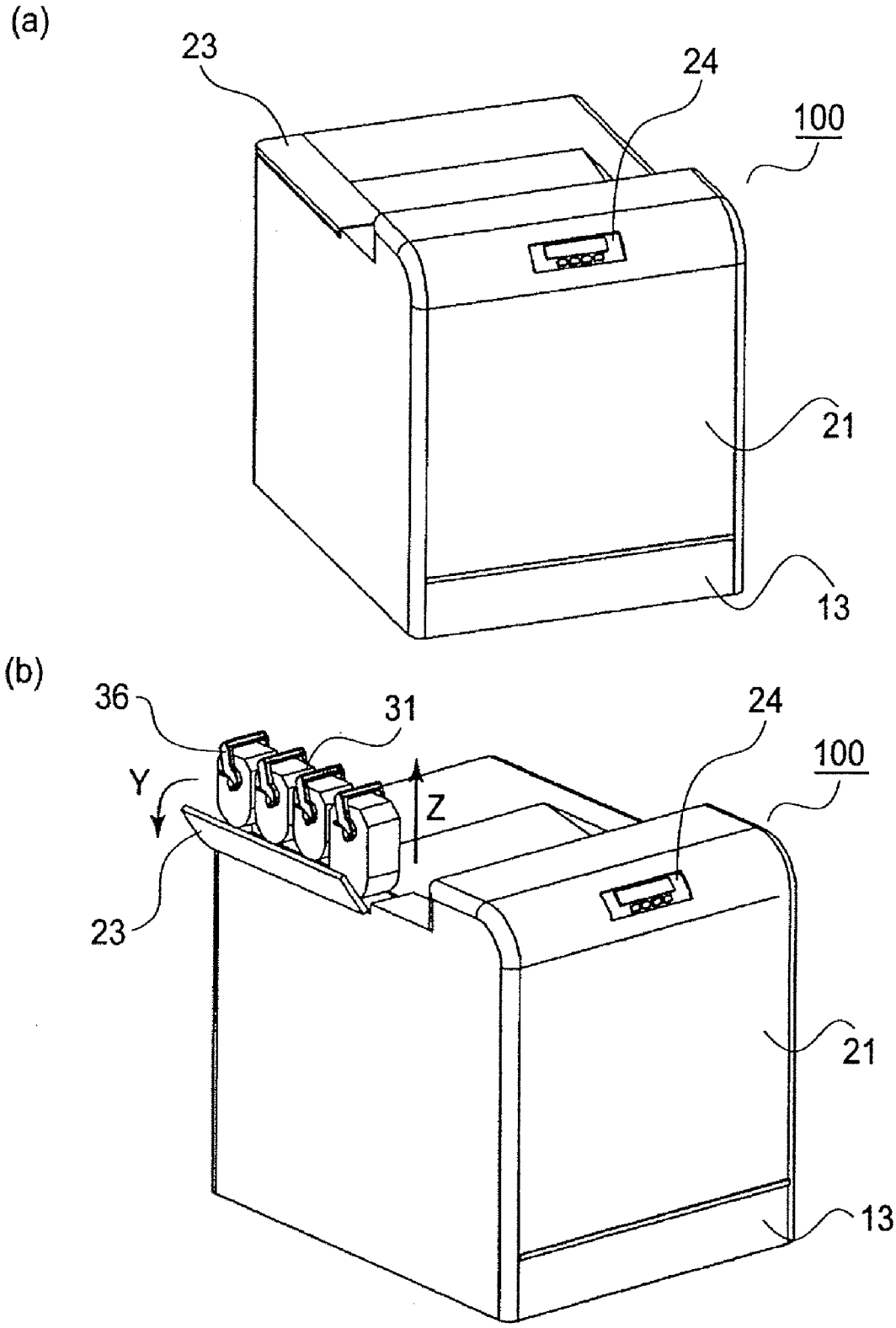
FIGS. 2(*a*) and 2(*b*) are external perspective views of the image forming apparatus main assembly.

A main assembly 100 of an image forming apparatus according to this embodiment and a developer supply container to be mounted into the image forming apparatus main assembly 100 will be described with reference to the drawings. First, a general structure of the image forming apparatus main assembly 100 will be described with reference to FIGS. 1 and 2. FIG. 1(*a*) is a schematic sectional view of the image forming apparatus main assembly 100 of this embodiment as seen in a left side surface of the image forming apparatus; FIG. 1(*b*) is a conceptual view showing a conveyance process of developer from the developer supply container to the image forming apparatus main assembly 100; FIG. 2(*a*) is an external perspective view of the image forming apparatus main assembly 100; and FIG. 2(*b*) is an external perspective view for illustrating a state of the image forming apparatus main assembly 100 during replacement of the developer supply container.

In FIG. 1(*a*), a front surface of the image forming apparatus is located on a right side on the drawing. Further, as shown in FIG. 2(*a*), the image forming apparatus is provided with a display operation portion 24 at an upper portion thereof, so that a housing cover 21, a sheet (paper) feeding cassette 13, and the like for releasing a conveyance path for paper jam treatment are operable from the front surface of the image forming apparatus.

Inside the image forming apparatus, as shown in FIG. 1(*a*), four photosensitive drums 1*a*, 1*b*, 1*c* and 1*d* as image bearing members for respective colors are disposed and from which respective color images are transferred onto an intermediary transfer belt 6 as an intermediary transfer belt 6 in a superposition manner, thus providing a full-color image. Accordingly, the image forming apparatus is a four drum-type (in-line) printer and achieves high speed by utilizing the four drums. The photosensitive drums 1*a* to 1*d* and developing devices 3*a* to 3*d* are disposed, in series in a substantially horizontal direction, vertically below the intermediary transfer belt 6, and are used for forming images of yellow, magenta, cyan, and black, respectively. A toner cartridge (e.g., a toner cartridge 31) as an example of each of developer supply containers for supplying developer to the developing devices 3*a* to 3*d*, respectively, is constituted so that it can be replaced from above the image forming apparatus. A surface of each of the photosensitive drums 1*a* to 1*d* is electrically charged uniformly by an associated one of charging apparatuses 2*a* to 2*d*. Thereafter, on the surface of each photosensitive drum, a latent image is formed by an associated one of exposure apparatuses 4*a* to 4*d* and is developed with developer to form an associated color toner image. The resultant four color toner images formed on the (four) photosensitive drums 1*a* to 1*d* are primary-transferred onto the intermediary transfer belt 6 in a superposition manner by primary transfer rollers 5*a* to 5*d*, respectively, thus forming a (full-) color toner image. The intermediary transfer belt 6 is extended under tension around a drive roller 7, a follower roller 8, and a tension roller 9 and is rotated around these rollers. The toner image on the intermediary transfer belt 6 is secondary-transferred onto a sheet by a secondary transfer roller 10. The sheet has been fed from a sheet feeding cassette 13 by a pickup roller 14 and conveyed to a secondary transfer portion while being timed to rotation of the intermediary transfer belt 6 by a pair of registration rollers 15. The sheet onto which the color toner image is transferred is subjected to application of heat and pressure by a fixing device 11 to fix the color toner image thereon, followed by discharge out of the image forming apparatus.

Four toner cartridges 31 into which fresh developers of four colors are filled, respectively, are mounted into the image forming apparatus main assembly 100. As shown in FIG. 1(*b*), inside of each toner cartridge 31, a stirring member 37, as described specifically later with reference to FIG. 3(*c*), is disposed and is rotated to permit discharge of developer from a developer discharge opening 30 of the toner cartridge 31. As a result, the developer is accumulated in a buffer portion 42. Below the buffer portion 42, a developer metering screw 43 and a conveyance screw 44 are disposed so as to convey the developer in the buffer portion 42 into a process cartridge. An amount of the developer fed by the developer metering screw 43 is divided into a plurality of portions equal in amount to each other at a space between a screw pitch and a pipe, so that it is possible to adjust a discharge amount of developer by an amount of rotation of the developer metering screw 43. The rotation amount of the developer metering screw 43 is determined from a video count value on the basis of a predetermined table, so that an appropriate amount of toner is discharged from the developer metering screw 43. During recording (image formation), the toner is fed into the developing device 3 by the conveyance screw 44 which is always rotating. Further, depending on the rotation amount of the developer metering screw 43, the stirring member 37 of the toner cartridge 31 is rotated, so that toner is supplied from the toner cartridge 31 to the buffer portion 42 to keep the amount of toner in the buffer portion 42 at a constant level.

At the buffer portion 42, an unshown toner sensor is disposed and sends a signal to a controller portion when the toner in the toner cartridge 31 is used up and is not discharged into the buffer portion 42 and thus the toner in the buffer portion 42 is used up, so that notification that a developer supply container for which color is emptied out is provided to a user. The user opens a cartridge cover 23 of the main assembly 100 in Y direction on the basis of the information from the main assembly 100 and takes the empty toner cartridge 31 out of the main assembly 100 in Z direction, and then mounts a new toner cartridge 31 in the main assembly 100. Thereafter, when the cartridge cover 23 is closed, a driving force is transmitted to the stirring member of the toner cartridge 31 on the basis of a signal from the controller portion, so that the inside of the buffer portion is refilled with toner to be returned to a recordable state.

Further, each of the photosensitive drums 1*a* to 1*d* is constituted as a process cartridge detachably mountable to the image forming apparatus main assembly. The process cartridge may include either one of the primary charge roller and the developing device, in addition to the photosensitive drum. In this embodiment, the photosensitive drum 1, the charging apparatus 2, and the developing device 3 are integrally disposed in the process cartridge. At an upper surface of the image forming apparatus, an openable and closable top cover 16 is disposed so as to permit replacement of the process cartridge integrally supporting the photosensitive drum, the developing device 3, and the like, and replacement of the intermediary transfer belt 6.

Here, as described above, with a demand for reduction in mounting space in a user office, the image forming apparatus main assembly 100 is required to be designed as a compact one, so that the above described respective members have to be designed to be compact in size and have to be disposed efficiently. Particularly, in the full-color image forming apparatus as in this embodiment, it is important to perform more efficient design since the toner cartridge 31, a developer supply container mounting portion 17 for mounting the toner cartridge 31 described later, the driving force transmitting mechanism, and the like are disposed four by four.

Further, in the image forming apparatus main assembly 100 in this embodiment, the design is performed in view of space saving with respect to not only the mounting space when the image forming apparatus main assembly 100 is mounted but also spaces (such as a space for opening the cover of the main assembly and a space for mounting the toner cartridge 31) necessary to replace the toner cartridge 31. Further, as shown in FIG. 2(*b*), a method of inserting the toner cartridge 31 from above the image forming apparatus main assembly 100 is adopted.

(Developer Supply Container)

Figure 3:
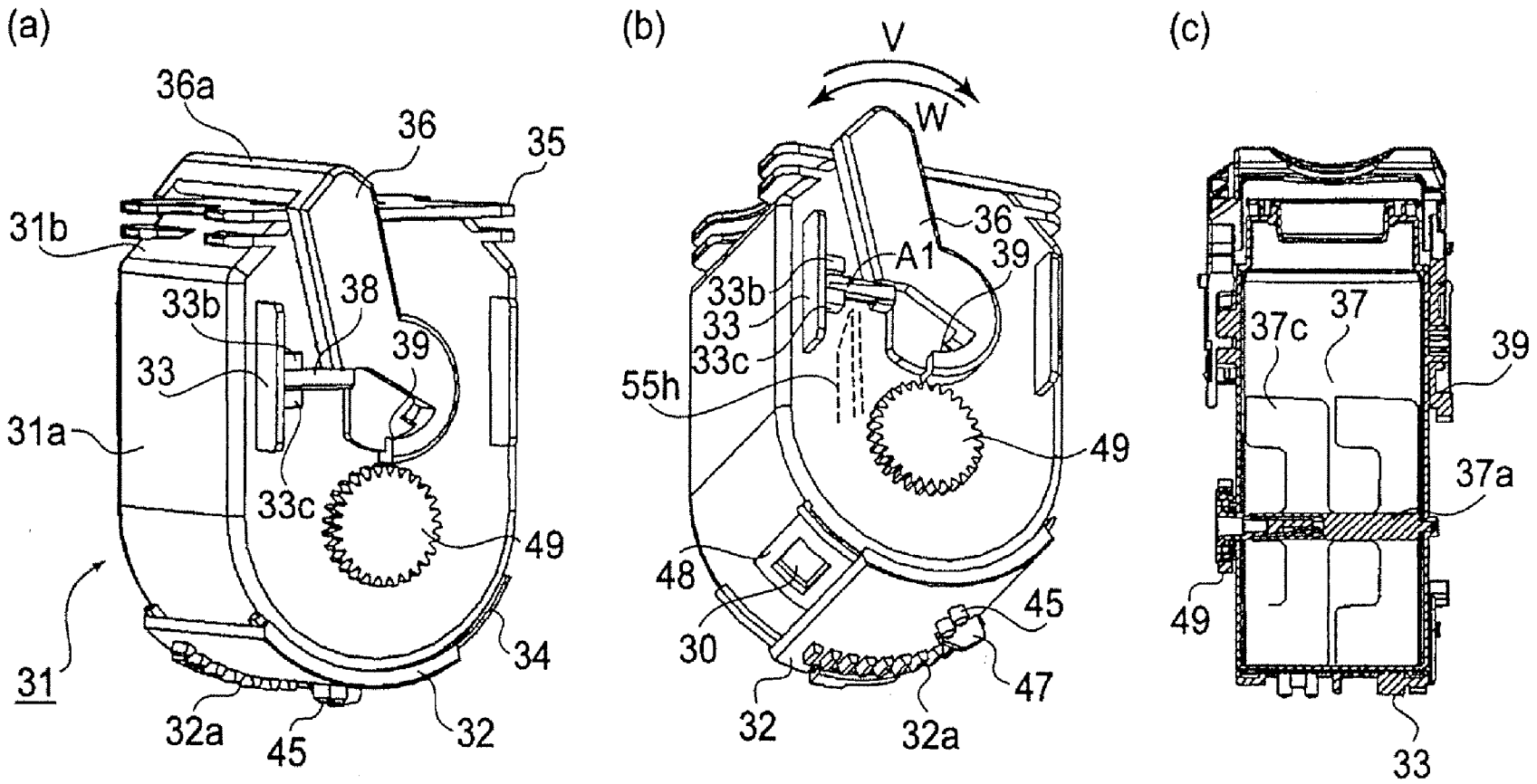
FIGS. 3(*a*) and 3(*b*) are perspective views of a toner cartridge including a front surface thereof, and FIG. 3(*c*) is a sectional view of the toner cartridge.
Figure 4:
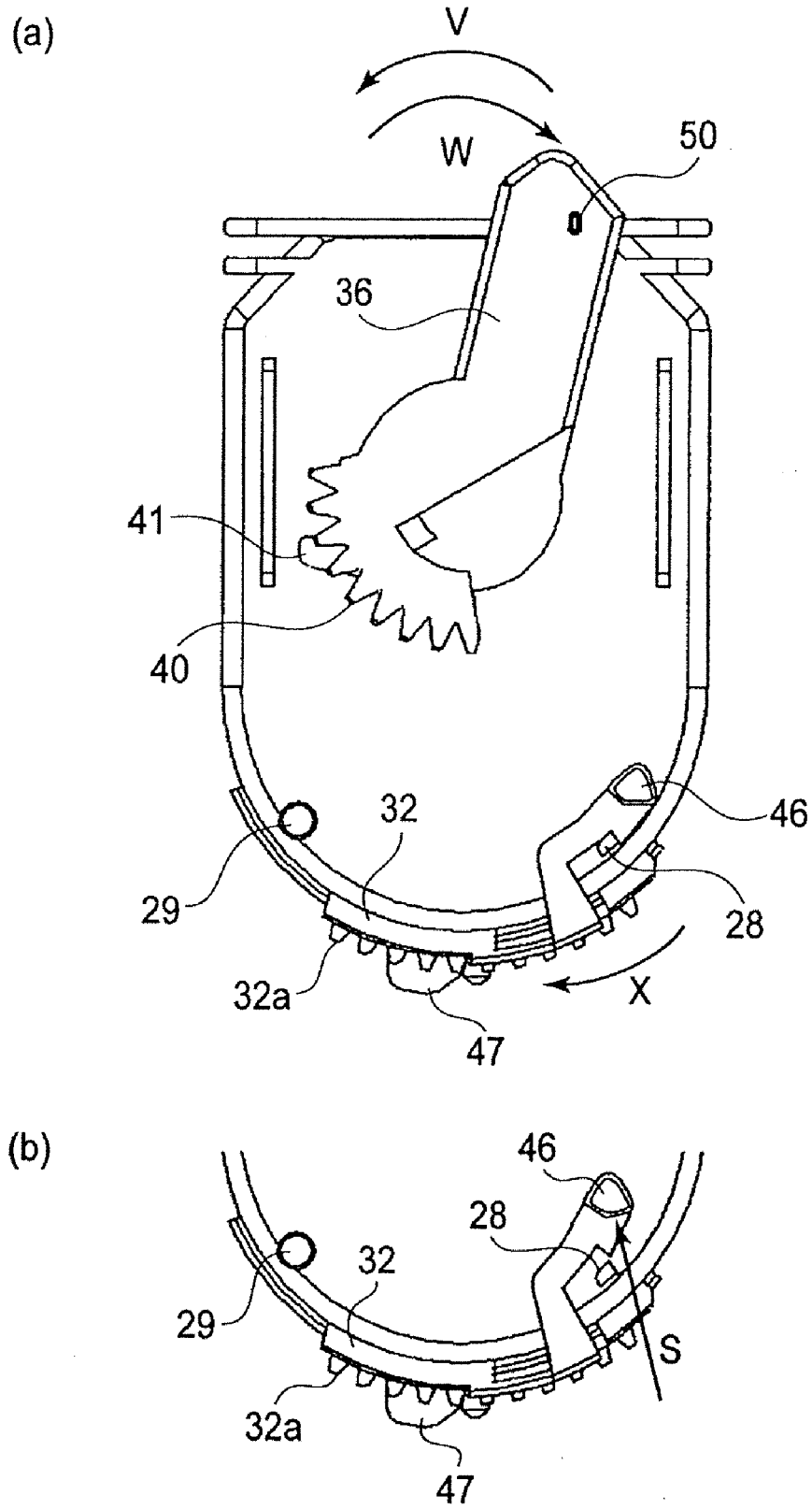
FIGS. 4(*a*) and 4(*b*) are rear views of the toner cartridge.
Figure 5:
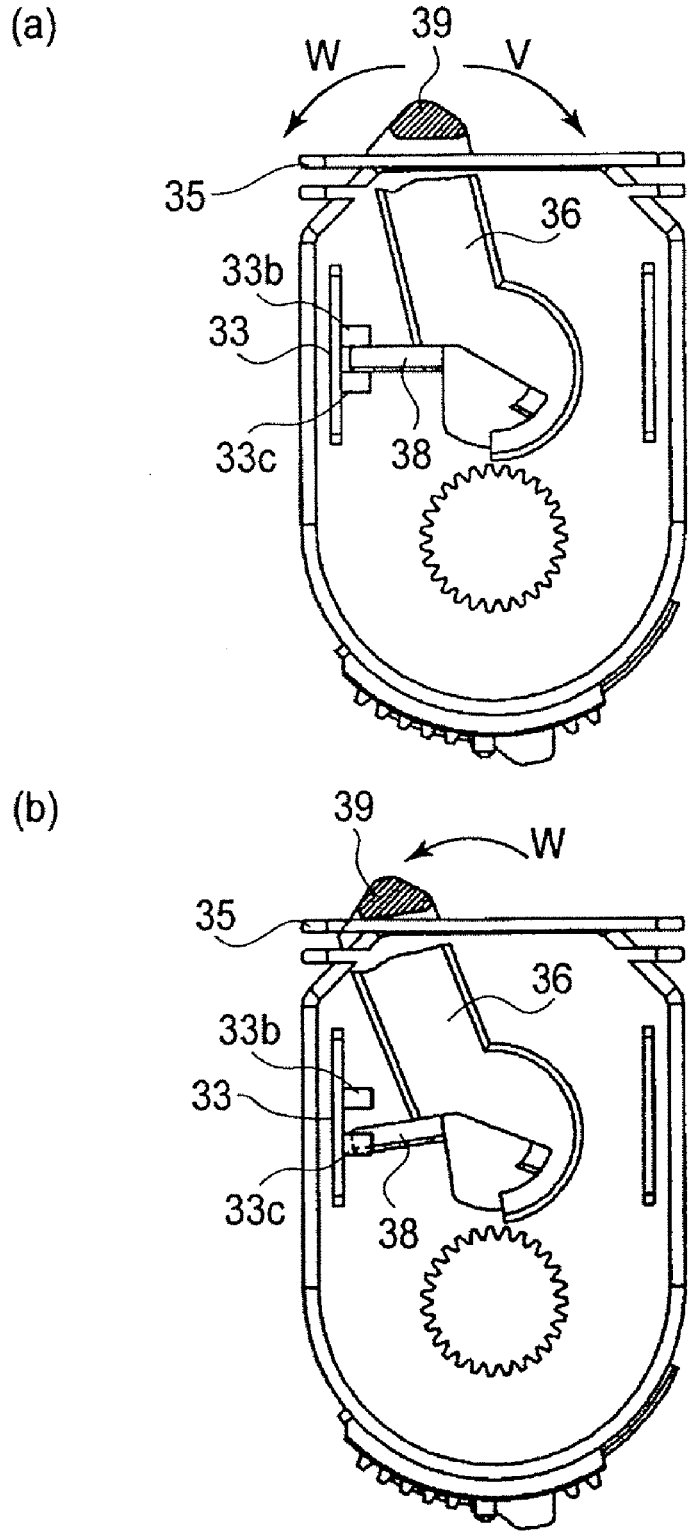
FIGS. 5(*a*) and 5(*b*) are explanatory views of rotational movement of a handle of the toner cartridge.
Figure 6:
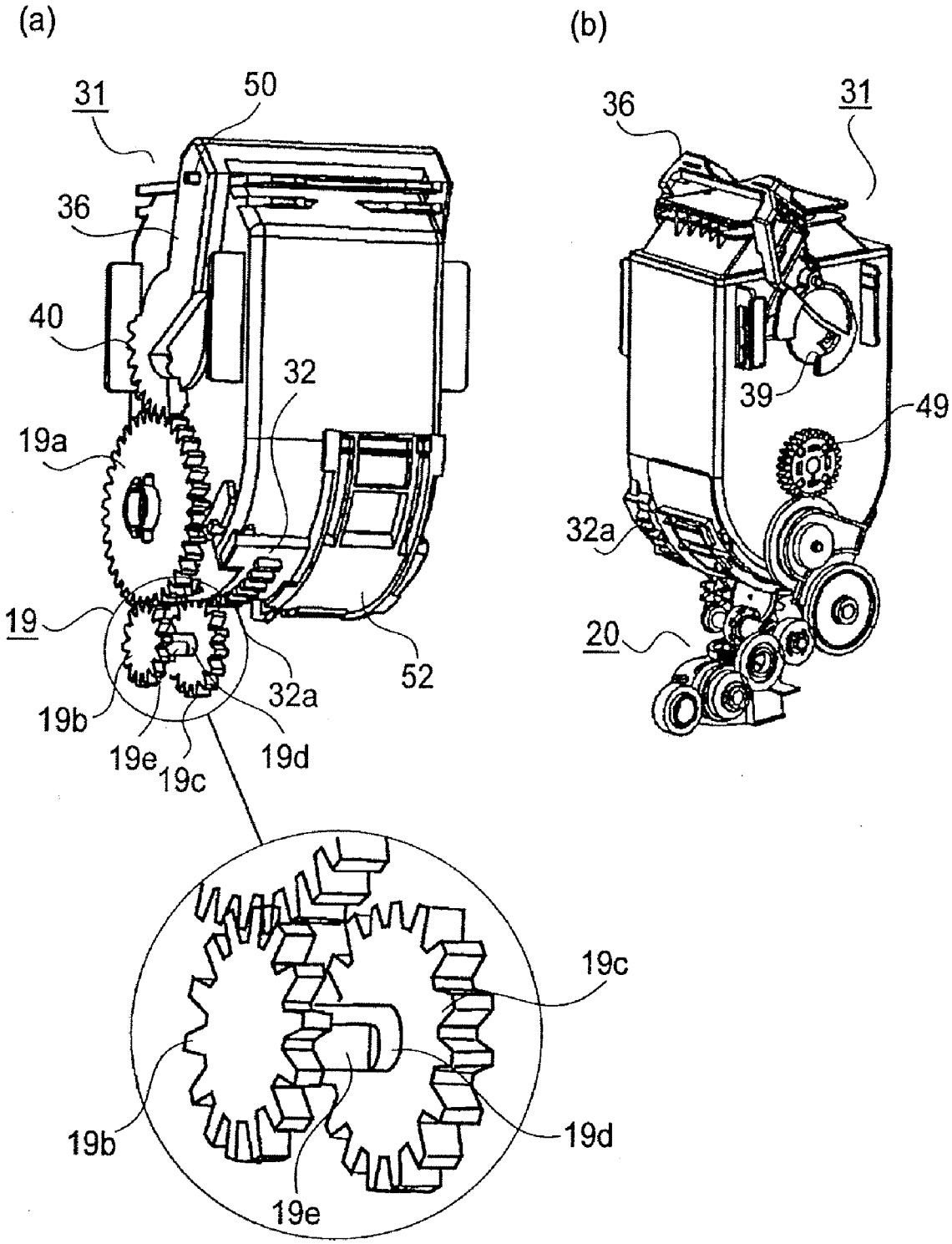
FIGS. 6(*a*) and 6(*b*) are schematic views for illustrating a driving force transmitting mechanism.
Figure 7:
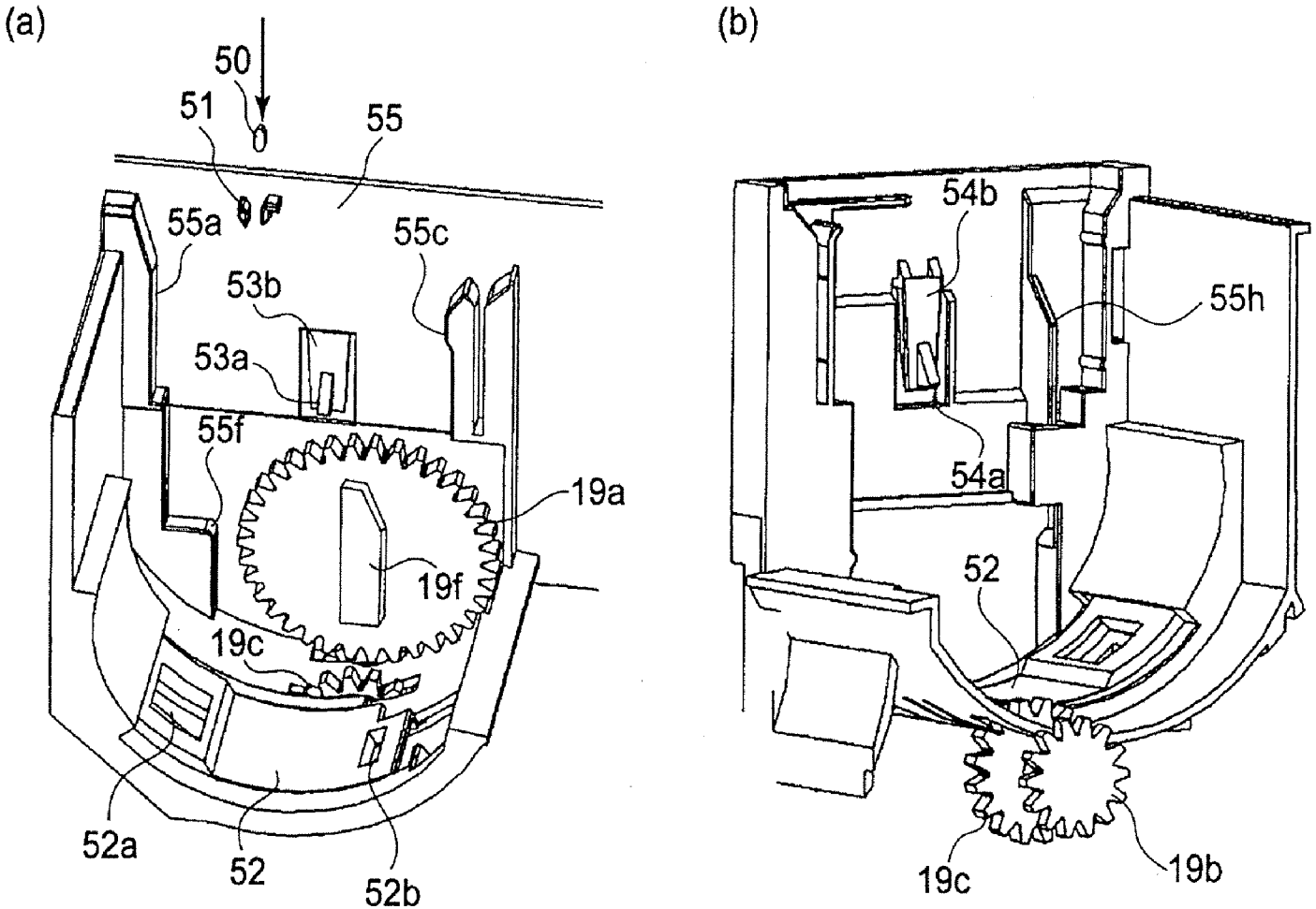
FIGS. 7(*a*) and 7(*b*) are explanatory views of a toner supply apparatus frame member of the image forming apparatus main assembly.
Figure 8:
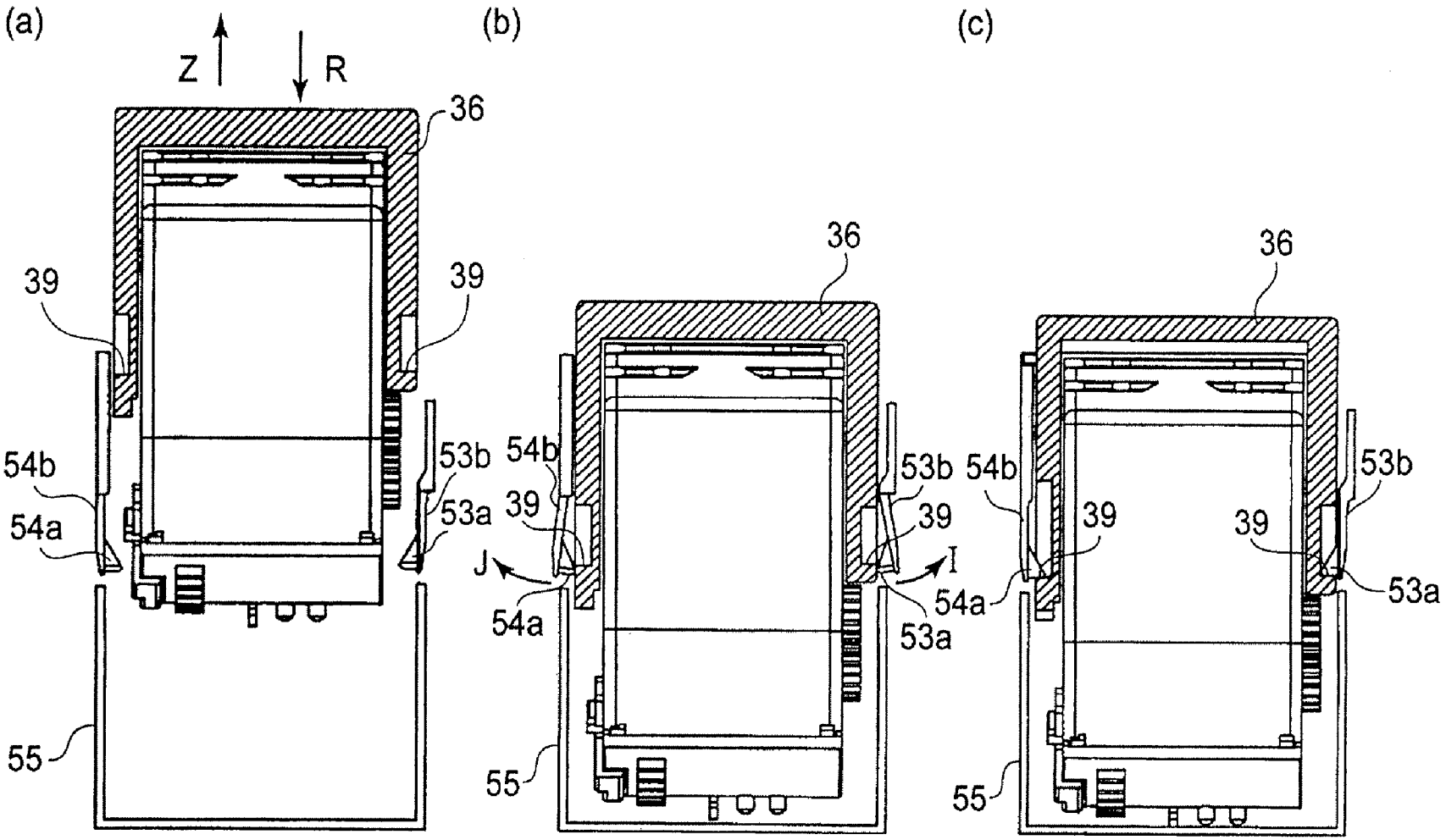
FIGS. 8(*a*), 8(*b*) and 8(*c*) are schematic views for illustrating a mounting operation of a developer supply container.

Next, the toner cartridge 31 of this embodiment will be described with reference to the drawings. FIGS. 3(*a*) and 3(*b*) are perspective views of a toner cartridge including a front surface thereof, and FIG. 3(*c*) is a sectional view of the toner cartridge. FIGS. 4(*a*) and 4(*b*) are rear views of the toner cartridge. FIGS. 5(*a*) and 5(*b*) are explanatory views of rotational movement of a handle of the toner cartridge. FIGS. 6(*a*) and 6(*b*) are schematic views for illustrating a driving force transmitting mechanism. FIGS. 7(*a*) and 7(*b*) are explanatory views of a toner supply apparatus frame member of the image forming apparatus main assembly. FIGS. 8(*a*), 8(*b*) and 8(*c*) are schematic views for illustrating a mounting operation of a developer supply container.

Figure 9:
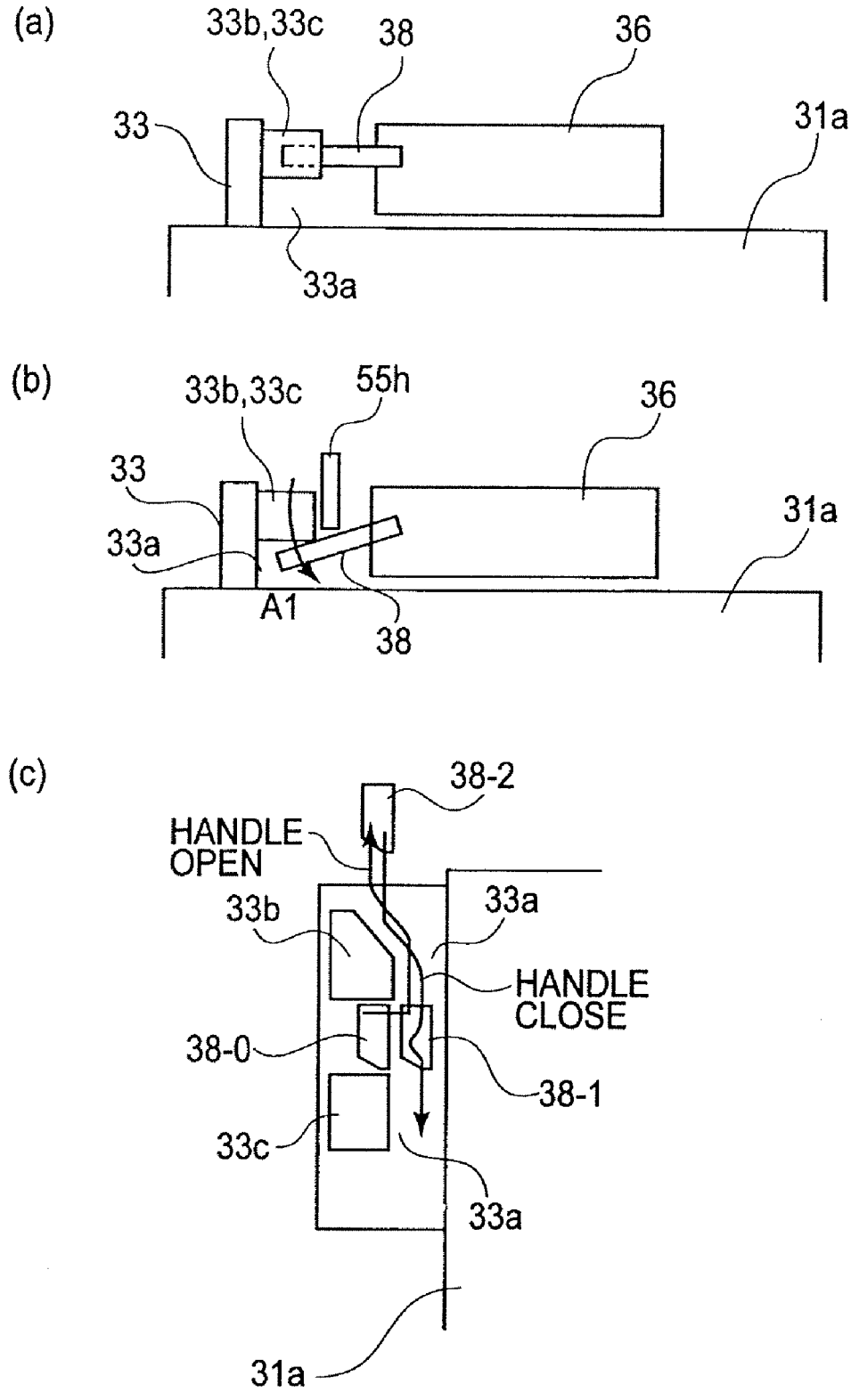
FIGS. 9(*a*), 9(*b*) and 9(*c*) are schematic views for illustrating a lock release mechanism of the handle.

FIGS. 9(*a*), 9(*b*) and 9(*c*) are schematic views for illustrating a lock release mechanism of the handle.

Figure 10:
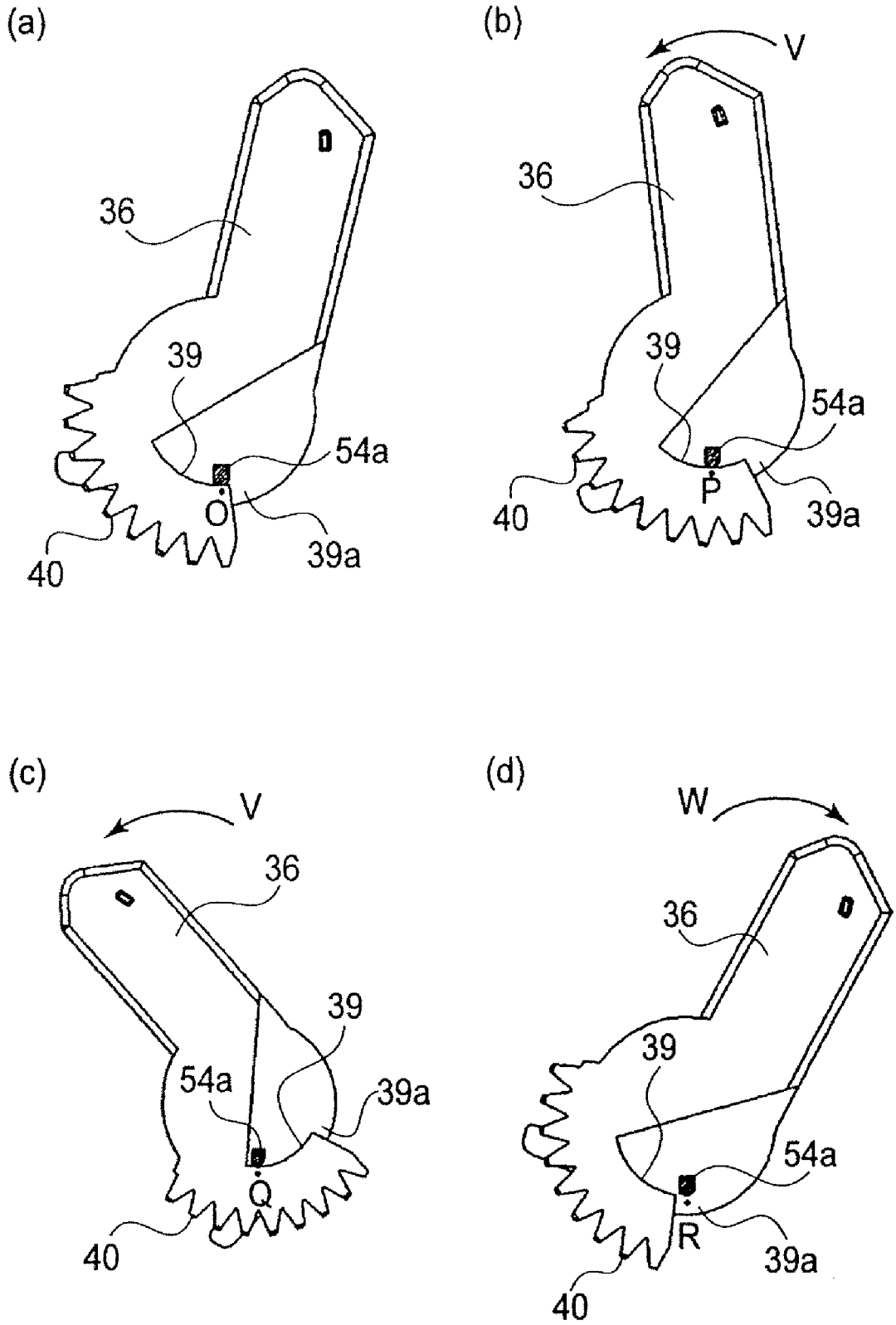
FIGS. 10(*a*) to 10(*d*) are schematic views for illustrating a relationship between an amount of rotational movement.
Figure 11:
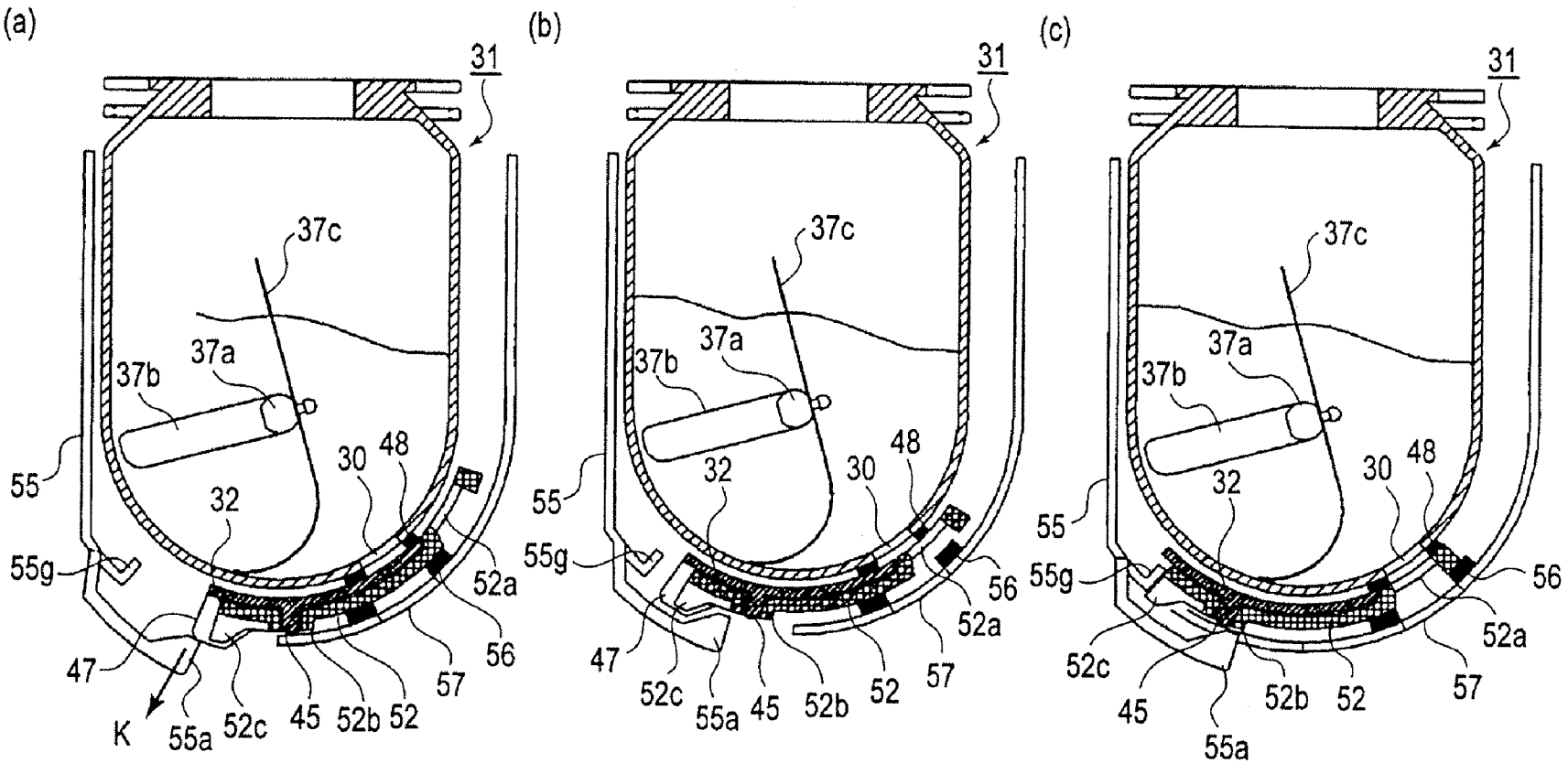
FIGS. 11(*a*), 11(*b*) and 11(*c*) are schematic views for illustrating a shutter.
Figure 12:
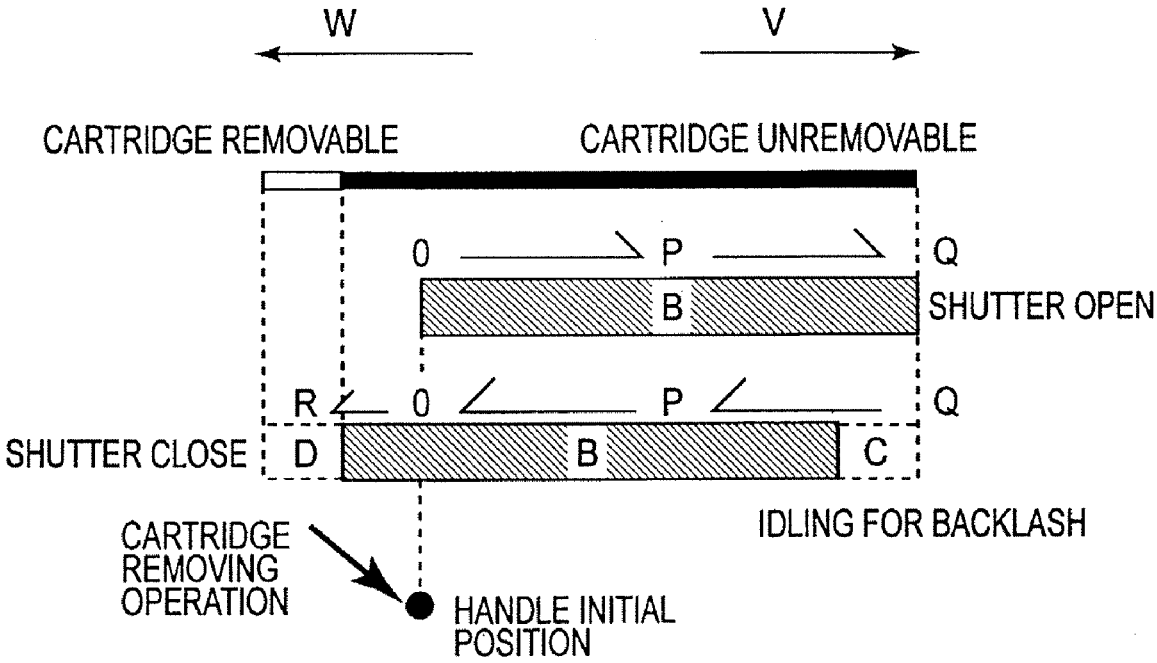
FIG. 12 is a schematic view for illustrating an amount of rotational movement and an operation of the shutter.

FIGS. 10(*a*) to 10(*d*) are schematic views for illustrating a relationship between an amount of rotational movement. FIGS. 11(*a*), 11(*b*) and 11(*c*) are schematic views for illustrating a shutter. FIG. 12 is a schematic view for illustrating an amount of rotational movement and an operation of the shutter.

The toner cartridge 31 is mounted into the image forming apparatus main assembly 100 and gradually supplies developer to a portion to be supplied with the developer while being mounted as it is, thus being of a so-called stationary type.

Incidentally, the toner cartridge 31 is mounted, at a position as shown in FIG. 2(*b*), to the image forming apparatus main assembly 100.

The toner cartridge 31 is, as shown in FIG. 3(*a*), provided with a handle 36 as an example of an operation member, a shutter rail 34, and a container shutter 32 slidable along the shutter rail 34. A toner container 31*a* is prepared by bonding a cover portion 31*b* thereto by a conventionally known means such as ultrasonic welding. As shown in FIG. 4(*b*), at a lower portion of the toner container 31*b*, a developer discharge opening 30 for supplying the developer is provided and a seal 48 is disposed so as to surround the developer discharge opening 48. Accordingly, when the container shutter 32 covers the developer discharge opening 30, a gap between the neighborhood of the developer discharge opening 30 and the container shutter 32 is sealed with the seal 48.

Inside the toner container 31*a*, as shown in FIG. 3(*c*), a stirring member 37 is disposed. The stirring member 37 is provided with a stirring blade 37*c* which is attached to a stirring shaft 37*a* and is rotated to function as means for feeding toner contained in the toner container 31*a* from the developer discharge opening. The stirring shaft 37*a* is disposed in a direction perpendicular to the insertion direction of the toner cartridge 31 and one end thereof is protruded out of the toner cartridge and provided with a stirring gear 49. The stirring gear 49 is engaged with a stirring drive mechanism 20 provided to the apparatus main assembly when the toner cartridge 31 is mounted into the main assembly, thus transmitting a driving force. The stirring drive mechanism 20 is a driving force transmitting mechanism comprising a gear train, and the stirring gear 49 comes close thereto from a direction perpendicular to the rotational axis, i.e., a direction perpendicular to a facewidth direction, and is engaged with the stirring drive mechanism 20.

To the container shutter 32, as shown in FIG. 4(*a*), a shutter lock 46 as an example of a container shutter locking portion is provided. In such a state that the toner cartridge 31 is not mounted into the apparatus main assembly, the shutter lock 46 is engaged with a shutter lock receiving portion 28, so that toner is not leaked out of the toner container due to the open of the container shutter 32 even when the container shutter 32 is erroneously slid in an open direction (indicated by an arrow X) by a user. Incidentally, the shutter lock 46 interferes with a shutter lock release projection 55 when the toner cartridge 31 is mounted into the image forming apparatus main assembly 100 (FIG. 7(*a*)), so that the shutter lock 46 is moved upward to release the engagement with the shutter lock receiving portion 28 as shown in FIG. 7(*b*), thus permitting movement of the container shutter 32.

The handle 36 is, as shown in FIGS. 3(*a*) and 4(*a*), axially supported at both side surfaces of the toner container 31*a* and can be rotationally moved in an open direction (arrow V direction) and a close direction (arrow W direction). However, as shown in FIG. 5(*b*), a grip portion 36 of the handle 36 abuts against a container grip 35 at an upper portion of the toner container 31*a*, so that a rotational movement angle is restricted. Further, as shown in FIG. 3(*a*), in the state that the toner cartridge 31 is not mounted into the apparatus main assembly, a handle lock 38 as an example of a lock means is held by an upper receiving portion 33, so that the handle 36 is fixed at a predetermined angle. The fixed position is an initial position of the handle 36 and as shown in FIG. 5(*a*), the handle 36 is set to be capable of being rotationally moved in both the V and W directions.

Further, the handle 36 is, as shown in FIG. 4(*a*), provided with a transmitting portion 40, for transmitting a driving force for opening and closing the developer discharge opening, comprising gears. The driving force transmitting portion 40 is, as shown in FIG. 6(*a*), engaged with a relay portion 19, for transmitting the driving force for opening and closing the developer discharge opening, provided to the apparatus main assembly to transmit the driving force to the driving force relay portion 19. The driving force relay portion 19 is a driving force transmitting mechanism comprising a gear train, and comes close to an idler gear 19*a* from a direction perpendicular to the rotational axis, i.e., a direction perpendicular to the face width direction, to be engaged with the idler gear 19*a*. The idler gear 19*a* is connected to a portion 32*a*, for receiving the driving force for opening and closing the, developer discharge opening, provided to the container shutter 32, through a small stepped gear 19*b* and a large stepped gear 19*c* which are an example of a plurality of gears having a common rotational axis and being different in number of teeth, thus transmitting the movement of the handle 36 as an open and close motion of the container shutter 32.

Further, the handle 36 is provided with a handle rail 39 as an example of a container-side engaging portion as shown in FIG. 3(*a*) and FIGS. 4(*a*) and 4(*b*). The handle rail 39 is a stepped member shaped in an arc around the rotational movement axis of the handle 36 and is engaged with projections 53*a* and 54*a* as an example of a main assembly-side engaging portion provided to the apparatus main assembly, thus fixing and holding the toner cartridge 31 with respect to the image forming apparatus main assembly. These projections 53*a* and 54*a* are disposed at ends of base portions 53*b* and 54*b* which are integrally formed with a toner supply apparatus frame 55 as shown in FIGS. 7(*a*) and 8(*a*). Each of the projections 53*a* and 54*a* has an inclined surface as an upper surface (on an upstream side in the toner cartridge 31 insertion direction) and a surface substantially perpendicular to the insertion direction as a lower surface (on a downstream side in the insertion direction).

At an outer peripheral surface of the container shutter 32, as shown in FIG. 3(*b*), an engaging boss 45 is disposed so that it protrudes from the surface of the container shutter 32. On the other hand, the apparatus shutter 52 provided to the apparatus main assembly is provided with an engaging hole 52*b* for being engaged with the engaging boss 45 during the mounting of the toner cartridge 31 as shown in FIG. 7(*a*). As shown in FIGS. 11(*a*) to 11(*c*), the container shutter 32 and the apparatus shutter 52 cooperate in performing an open/close operation, so that three openings including a developer receiving opening 57 provided to the toner supply apparatus frame 55 of the apparatus main assembly, a toner supply opening 52*a* provided to the apparatus shutter 52, and the developer discharge opening 30 provided to the toner container 31*a*, communicate with each other. As a result, supply of the toner is performed. Around the developer receiving opening 57, a main assembly opening seal 56 is provided, so that leakage of the toner from a gap between the developer receiving opening 57 and the apparatus shutter 52 is prevented.

<Operation During Mounting of Developer Supply Container>

An operation when the toner cartridge 31 is mounted will be described with reference to FIGS. 8(*a*) to 8(*c*).

First, a user opens the toner cartridge cover 23 of the image forming apparatus main assembly 100 in the Y direction (FIG. 2(*a*)). Then, as shown in FIG. 8(*a*), the user grips the container grip 35 at the upper portion of the toner container and starts to insert the toner cartridge 31 from above the main assembly into the toner supply apparatus frame 55 of the main assembly in a direction of an arrow R. At this time, the handle 36 is interposed between an upper handle lock receiving portion 33*b* and a lower handle lock receiving portion 33*c* of the toner container to be fixed at an initial position.

As shown in FIG. 8(*b*), the toner cartridge 31 is further inserted and when the inclined upper surfaces of the projections 53*a* and 54*a* contact the handle rail 39 of the handle 36, the base portions 53*b* and 54*b* of the projections 53*a* and 54*a* are elastically deformed. As a result, the projections 53*a* and 54*a* are moved outward in directions (indicated by arrows I and J), so that the toner cartridge 31 is inserted smoothly.

Further, as shown in FIG. 8(*c*), when the toner cartridge 31 is completely inserted, the projections 53*a* and 54*a* enter spaces above the handle rail 39 by a restoring force of the base portions 53*b* and 54*b*. As described above, by only such an operation that the toner cartridge 31 is fixed and held, so that the toner cartridge 31 is restricted in movement toward the removal direction. At this time, as shown in FIG. 6(*a*), the driving force transmitting portion 40 of the handle 36 is engaged with the idler gear 19*a* of the driving force relay gear train 19, and the driving force transmission receiving portion 32*a* of the container shutter 32 is engaged with the large stepped gear 19*c*. Further, as shown in FIG. 11(*a*), the engaging boss 45 (FIG. 3(*b*)) of the container shutter 32 is engaged with the engaging hole 52*b* of the apparatus shutter 52. In this state, when the handle 36 is rotationally moved, the container shutter 32 and the apparatus shutter 52 are placed in such a state that they can integrally cooperate to perform the open/close operation. In this state, it is possible to regulate a center distance between the driving force transmitting portion 40 and the driving force relay portion 19 (FIG. 6(*a*)) and a center distance between the stirring gear 49 and the gear of the stirring drive mechanism 20 (FIG. 6(*h*)), so that the driving force transmission is performed with reliability.

In such a state that the toner cartridge 31 is only mounted, as shown in FIG. 10(*a*), the handle 36 is located at an initial position, and the handle rail 29 and the projection 54*a* are in such a positional relationship that they are engaged with each other at a position O. The handle lock 38 is not released until immediately before the toner cartridge 31 is completely inserted into the toner supply apparatus, so that this positional relationship is always kept. On the other hand, as shown in FIG. 7(*b*), the toner supply apparatus frame 55 of the apparatus main assembly is provided with a handle lock release rib 55*h* for releasing the handle lock 38. The handle lock release rib 55*h* abuts against the handle lock 38 during the insertion of the toner cartridge 31 as shown in FIG. 3(*b*), so that an end of the handle lock 38 is bent toward the toner container 31*a* (in a direction of an arrow A1). As a result, the handle lock 38 is deviated from the handle lock receiving portion 33 to be released therefrom, so that the handle 36 is placed in a rotationally movable state.

An operation of the handle lock 38 at that time will be described with reference to FIGS. 9(*a*) to 9(*c*), wherein FIGS. 9(*a*) and 9(*b*) are schematic views of the handle lock 38 and the handle lock receiving portion 33 as seen in a direction from below these members, and FIG. 9(*c*) is a schematic view of the neighborhood of the handle lock 38 as seen in the direction of the handle 36. FIG. 9(*a*) shows a state that the handle 36 is locked. As shown in FIG. 9(*b*), when the handle lock release rib 55*h* abuts against the handle lock 38 by the insertion of the toner cartridge 31, the end of the handle lock 38 is deformed toward a direction of an arrow A1 and is capable of entering a spacing between the toner container 31*a* and receiving portions 33*b* and 33*c*. More specifically, as shown in FIG. 9(*c*), the handle lock 38 located at a portion 38-0 at the time of the handle release is moved to a position 38-1 close to the toner container 31*a*, thus permitting rotation of the handle 36.

Further, by this inserting operation, a shutter lock 46 of the container shutter 32 is raised by a shutter lock release projection 55*f* in an upward direction (indicated by an arrow S shown in FIG. 4(*b*)), so that the container shutter 32 is placed in an openable and closable state. Incidentally, the raising direction of the shutter lock 46 is approximately parallel to a direction toward a rotation center of the container shutter 32, and a rotational resistance by the contact with the seal 48 under pressure is generated, so that the container shutter 32 is not accidentally moved by the release of the shutter lock 46. Further, as shown in FIG. 11(*a*), a lock release rib 47 (FIG. 4(*b*)) provided to the container shutter 32 presses down on a lock 55*a* of the apparatus shutter 55 to release the lock 55*a*, thus placing also the apparatus shutter 55 in the openable and closable state.

Next, when the grip portion 36*a* is tilted toward a direction of an arrow V as shown in FIG. 10(*b*), the driving force is transmitted from the driving force transmitting portion 40 through the driving force relay portion 19, so that the container shutter 32 and the apparatus shutter 52 start to rotationally move as shown in FIG. 11(*b*). The handle rail 39 is arc-shaped and the projections 53*a* and 54*a* are disposed on a center line of rotational movement of the handle 36, so that the projections 53*a* and 54*a* continue holding the handle rail 39 at a position P (FIG. 10(*b*)). Lower ends of the projections 53*a* and 54*a* are formed in a bend shape, so that they can reduce a contact surface with the handle rail, thus decreasing a resistance during the rotation of the handle. Incidentally, in order to improve operability, it is also possible to provide small rollers at lower ends of the projections 53*a* and 54*a* to further decrease the rotation resistance. When the handle is rotated so that the handle lock 38 located at a position other than the positions of the receiving portions 33*b* and 33*c*, the handle lock 38 is restored from the elastically deformed state to a position 38-2 (FIG. 9(*c*)).

As shown in FIG. 10(*c*), when the grip is fully tilted toward the arrow V direction, the container shutter 32 and the apparatus shutter 52 are placed in a full open state as shown in FIG. 11(*c*) to permit the supply of toner. In this state, the apparatus shutter 52 abuts against the abutting portion 55*g* provided to the toner supply apparatus frame 55 to be restricted in movement, and the handle 36 also reaches its limit of rotational movement. Also in this case, the projections 53*a* and 54*a* continue holding of the handle rail 39 at a position Q. Thereafter, when the cartridge cover 23 is closed, the image forming apparatus main assembly 100 is restored to the recordable (image formable) state. As described above, by such a simple operation that the handle 36 is only rotated, the container shutter 32 and the apparatus shutter 52 are opened to place the image forming apparatus main assembly in the recordable state.

<Operation During Removal of Developer Supply Container>

When toner in the toner container 31*a* is used up and is not supplied from the developer discharge opening 30 to the buffer portion, a toner sensor at the buffer portion detects no toner and a cartridge replacement massage is displayed. The user opens the cartridge cover 23 and performs the replacement of the toner cartridge 31.

More specifically, first, the user rotates the grip portion 36*a* in a direction of an arrow W in order to close the container shutter 32 of the toner cartridge 31 and the apparatus shutter 52. Then, by further rotating the handle 36 so that it exceeds the initial position shown in FIG. 10(*a*), the projection 54*a* reaches a position R corresponding to a terminated portion 39*a* at which the handle rail 39 is terminated. As a result, the engagement of the projections 53*a* and 54*a* with the handle rail 39 is released, so that removal of the toner cartridge 31 becomes possible. Accordingly, in the case where the toner is emptied, the shutters are closed by such a simple operation that the handle 36 is only rotated to place the toner cartridge 31 in a removal state.

Here, an amount of rotational movement of the handle 36 will be described with reference to FIG. 12.

Referring to FIG. 12, an uppermost bar line represents whether the toner cartridge 31 is removable or unremoved, and second bar line represents the amount of handle rotational movement during the opening of the shutters. Symbols O, P and Q correspond to those representing the positional relationships between the handle 36 and the projection 54*a* shown in FIGS. 10(*a*), 10(*b*) and 10(*c*). When the shutters are opened, the handle 36 is rotationally moved by B.

A third bar line represents the amount of handle rotational movement during the close of the shutters. As described above, the driving force is not transmitted in an amount corresponding to backlash of the gear when the handle 36 starts to be moved, so that only the handle 36 is moved in an amount C. Further, the handle 36 is rotated in the amount B but the toner cartridge 31 cannot be removed since the projection 54*a* is engaged with the handle rail 39. Then, when the handle 36 is further rotated in an amount D, the terminated portion 39*a* (position R) comes immediately under the projection 54*a*, so that it is possible to remove the toner cartridge 31.

The amount of handle rotational movement (Q to R) in the shutter close direction is larger than the amount of handle rotational movement in the shutter open direction (O to Q). However, by setting a length of the handle rail corresponding to the amount (O to R) so that it is not less than that corresponding to backlash loss, it is possible to realize such a state that the toner cartridge 31 can be removed only after the container shutter 32 and the apparatus shutter 52 are returned to their original positions.

Further, as shown in FIG. 9(*c*), at the upper surface of the upper receiving portion 33*b* of the handle lock receiving portion 33 is provided with an inclined surface, so that the handle lock 38 is naturally deformed along the inclined surface to enter a spacing 33*a* during the closing of the handle 36. Incidentally, the spacing 33*a* is also provided between the lower receiving portion 33*c* and the toner container 31*a*, so that the handle 36 can be further rotated when compared with the case of the initial position.

The handle 36 is, after the projections 53*a* and 54*a* reach the terminated portion 39*a*, stopped at such a further moved position at which an upper surface of the container grip 35 and a lower surface of the grip portion 36*a* run against each other. At this time, the main assembly shutter lock 55*a* elastically restored to the original position to lock the apparatus shutter 52. By the above described constitution, it is possible to ensure that the shutters are closed when the user removes the toner cartridge 31 from the image forming apparatus main assembly. By adopting such a constitution that the toner cartridge 31 cannot be taken out until the shutters are completely closed, it is possible to prevent toner scattering from the toner container and accumulation of deviation of the shutters due to repetitive mounting and demounting of the toner cartridge.

Further, when the toner cartridge 31 is taken out, the shutter lock 46 is not supplied with a pressing force from the shutter lock release projection 55*f* on the toner cartridge 31 side, so that the shutter lock 46 is elastically restored to the original position to be engaged with the shutter lock receiving portion 28. As a result, it is possible to prevent the container shutter 32 from being accidentally opened, so that there is no worry that the toner in the container is scattered out, and handling of the toner cartridge outside the main assembly becomes easy.

Further, at a lower portion below a center of the rotational movement of the handle 36, an abutting portion 41 as an example of a container-side return means is provided (FIG. 4(*a*)). On the other hand, a return abutting portion 55*c* as an example of a main assembly-side return means is provided on the main assembly side as shown in FIG. 7(*a*). The abutting portion 41 abuts against the return abutting portion 55*c* when the toner cartridge 31 is taken out of the main assembly, so that the handle 36 is rotationally moved to restore its phase to the initial position. In this state, the handle lock 38 is elastically restored to the original position and enters the spacing (the position 38-0 in FIG. 9(*c*)) between the upper and lower receiving portions 33*b* and 33*c* to be fixed. Accordingly, even when the same toner cartridge 31 is inserted again, the handle operation can be performed always under the same condition. Further, in such a state that the toner cartridge 31 is outside the main assembly, the handle 36 is always locked, so that it is possible to further improve the operability.

<Characterized Constitution of this Embodiment>

Figure 13:
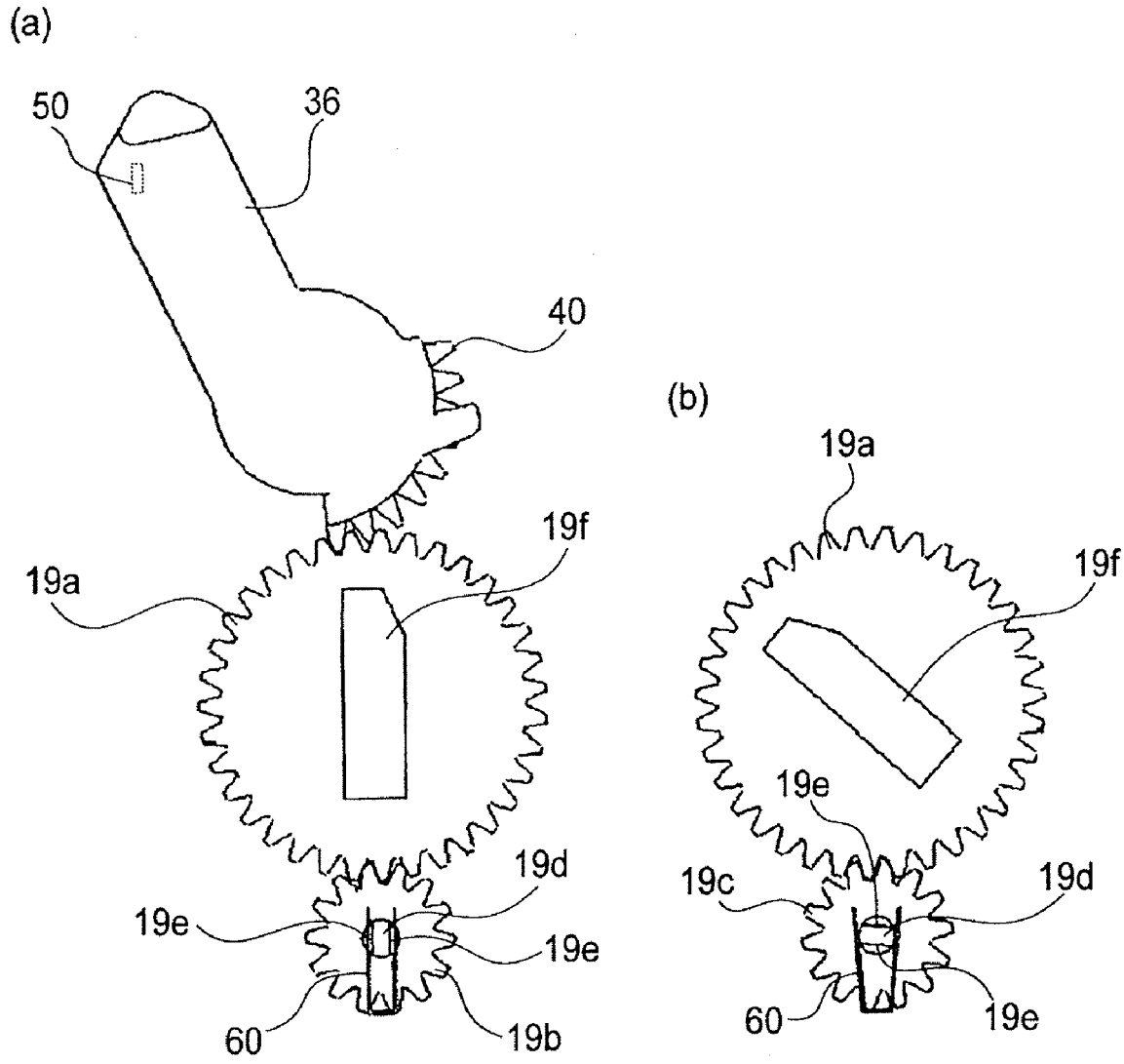
FIGS. 13(*a*) and 13(*b*) are schematic views for illustrating a gear return means.
Figure 14:
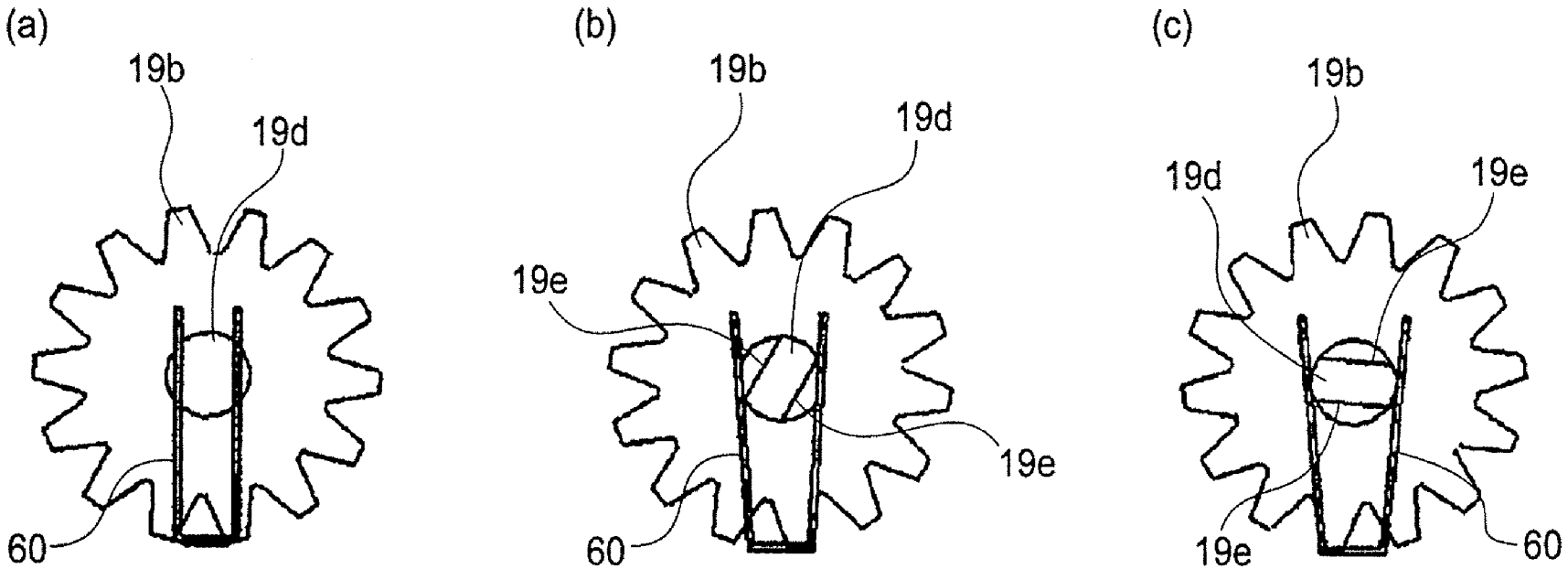
FIGS. 14(*a*), 14(*b*) and 14(*c*) are schematic views for illustrating an operation of the gear return means.
Figure 15:
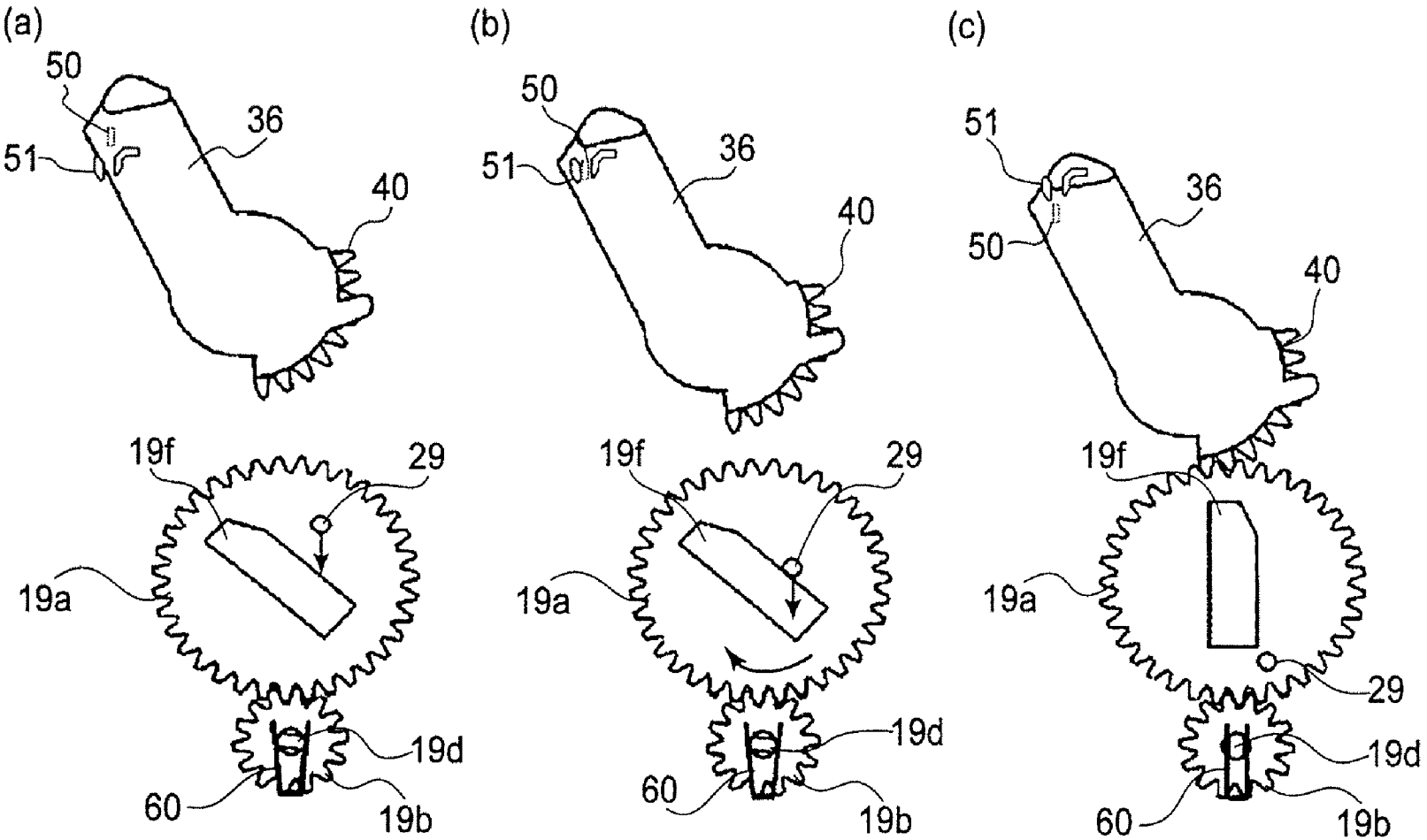
FIGS. 15(*a*), 15(*b*) and 15(*c*) are schematic views for illustrating an operation of a gear-side abutting portion and a container-side abutting portion.
Figure 16:
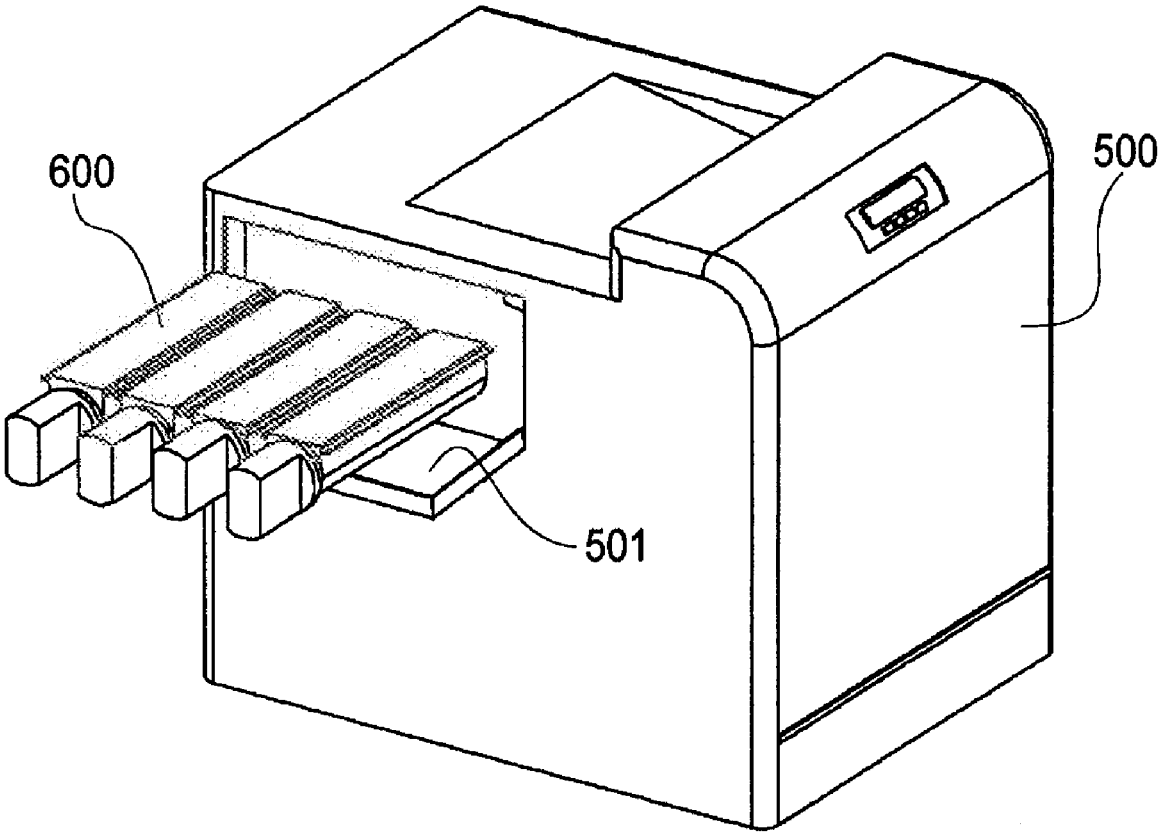
FIG.16 PRIOR ART
FIG. 16 is an explanatory view of a conventional image forming apparatus.
Figure 17:
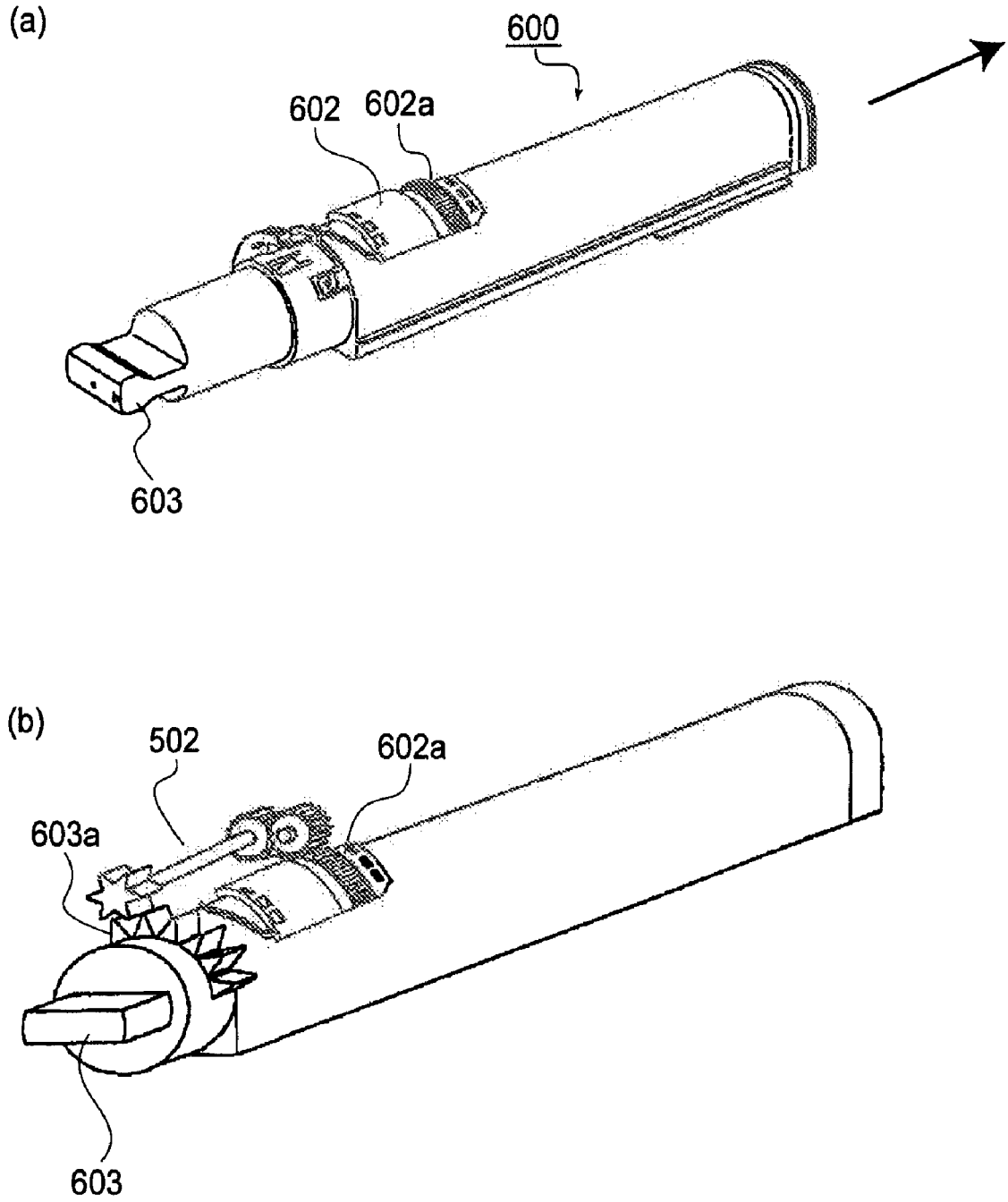
FIG.17 PRIOR ART
FIGS. 17(*a*) and 17(*b*) are explanatory views of a conventional developer supply container.
Figure 18:
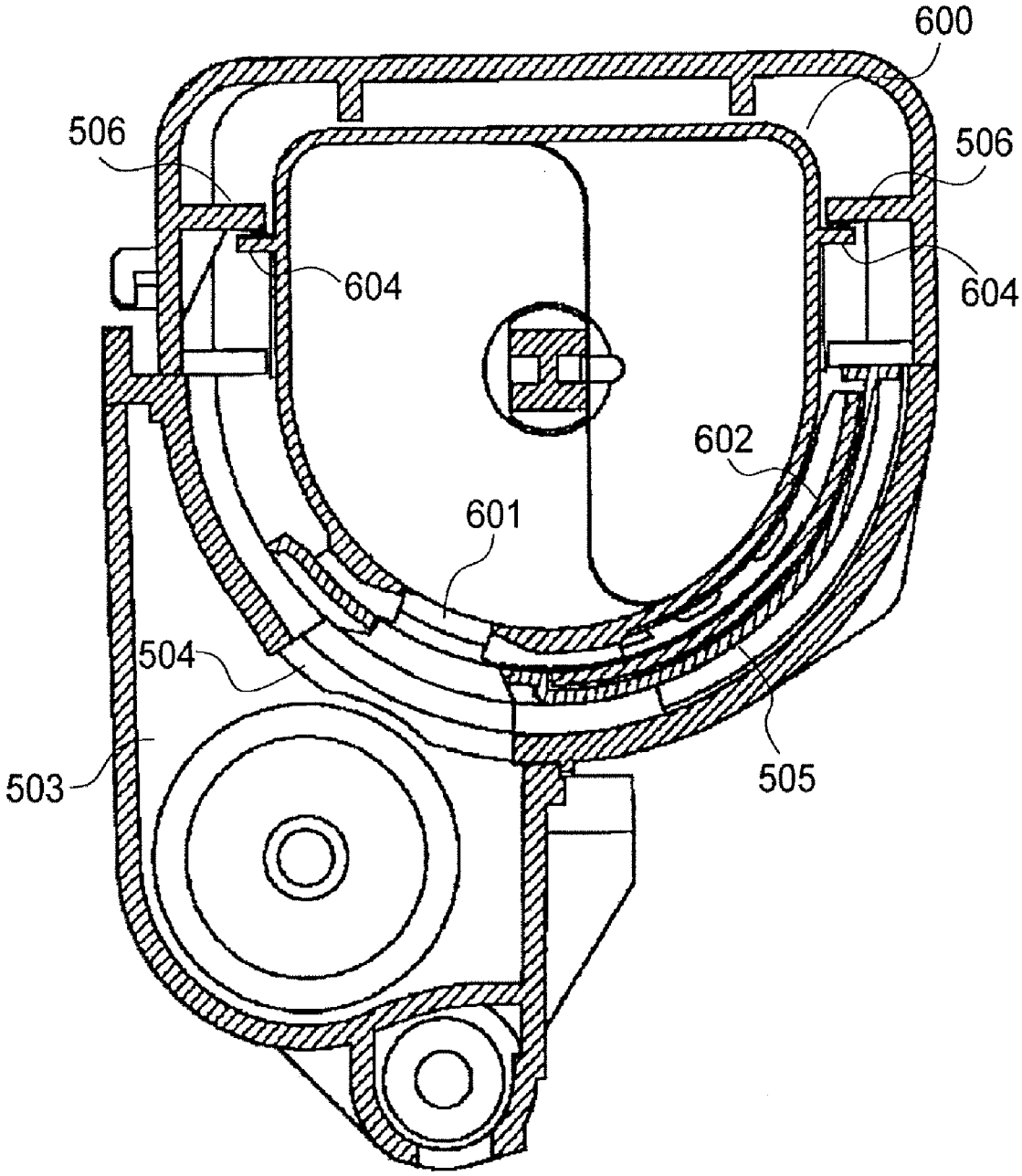
FIG. 18 is a sectional view for illustrating a mounted state of the conventional developer supply container.
Figure 19:
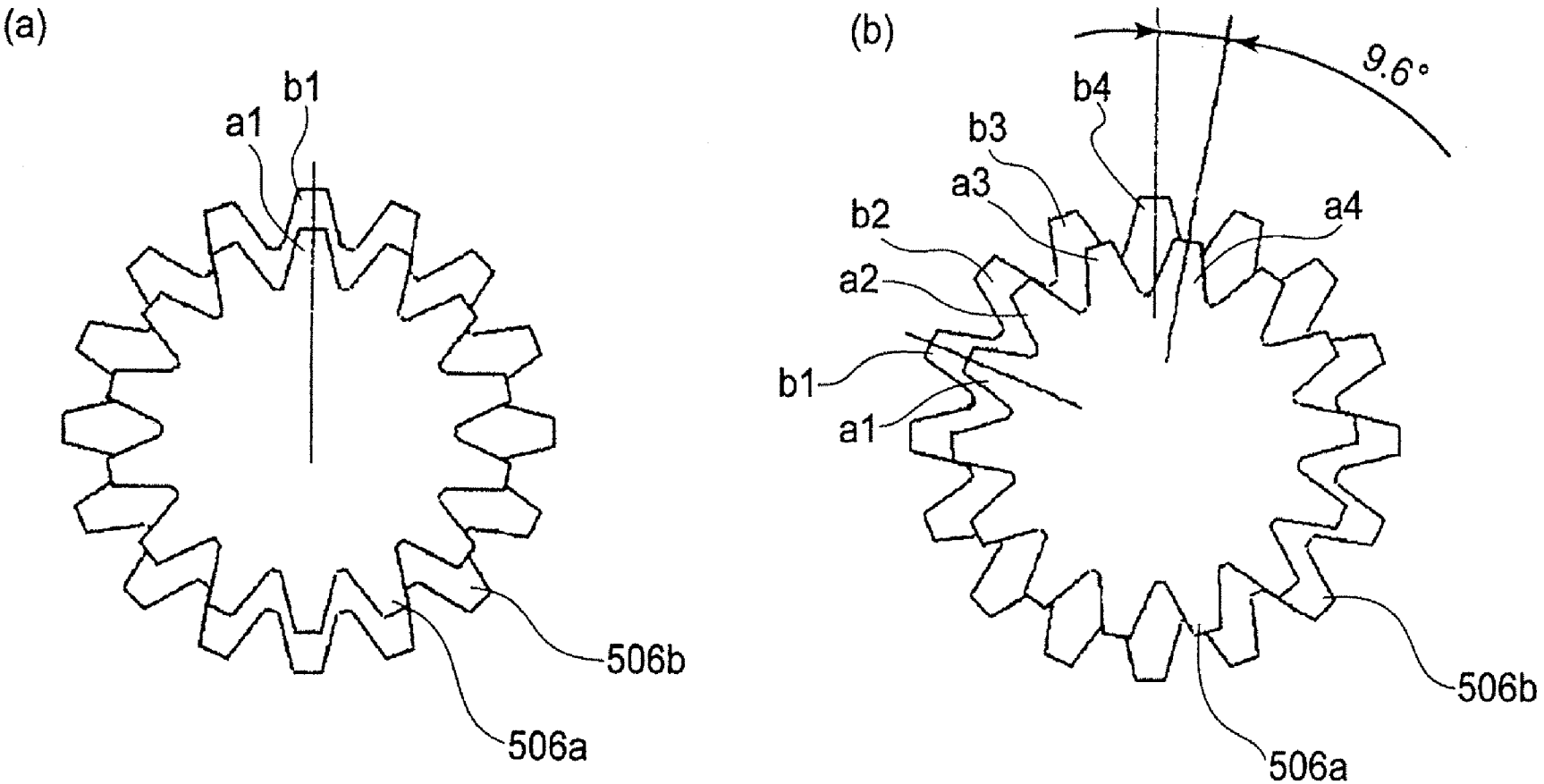
FIGS. 19(*a*) and 19(*b*) are schematic views for illustrating a phase of teeth of a stepped gear.

Next, characterized constitution and operation in this embodiment will be described. FIGS. 13(*a*) and 13(*b*) are schematic views for illustrating a gear return means; FIGS. 14(*a*) to 14(*c*) are schematic views for illustrating an operation of the gear return means; and FIGS. 15(*a*) to 15(*c*) are schematic views for illustrating an operation of a gear-side abutting portion and a container-side abutting portion.

As shown in FIGS. 6(*a*) and 13(*a*), the rotational axis (shaft) 19*d* for axially supporting the small and large stepped gears 19*b* and 19*c* of the driving force relay portion 19 is provided with two opposite flat portions 19*e*. Further, the apparatus main assembly is provided with a holding member 60 comprising a plate spring which has the same flat surface as the flat portions 19*e* and is urged against the flat portions 19*e*. The flat surface of the holding member 60 is set to have a width narrower than that of the flat portions 19*e* and the holding member 60 is disposed so as to sandwich the flat portions 19*e*. These flat portions 19*e* and the holding member 60 constitute the gear return means.

FIGS. 14(*a*) to 14(*c*) show a phase of the rotational axis 19*d* and a state of the holding member 60, wherein FIG. 14(*a*) shows the phase when the driving force relay portion 19 is located at the initial position, FIG. 14(*b*) shows the phase when the toner cartridge is removed from the main assembly, and FIG. 14(*c*) shows the phase in such a state that the shutter member is opened.

When the toner cartridge 31 is not mounted as shown in FIG. 14(*a*), the flat portions 19*e* follow the flat surface of the holding member 60 by an elastic force of the holding member 60, so that it is possible to set phases of all the gears of the driving force relay portion 19 at their initial positions. In this state, any means is not connected to both ends of the gear train of the driving force relay portion 19, so that the gear train can be rotated by a small torque.

Further, as shown in FIG. 14(*b*), in such a state that the toner cartridge 31 is removed, the handle 36 is excessively rotated toward the removal side rather than the initial position, so that the driving force relay portion 19 (the rotational axis 19*d*) is also excessively rotated toward the initial position. However, this state can be corrected by the gear return means (the flat portions 19*e* and the holding member 60), so that the driving force relay portion 19 can be freely rotated by removing the toner cartridge 31 from the apparatus main assembly so as to be returned to the phase shown in FIG. 14(*a*).

On the other hand, when the container shutter 32 and the apparatus shutter 52 are opened as shown in FIG. 14(*c*), the rotational axis 19*d* is set to be largely rotated to a position out of a correctable range (a position at which arcuate portions other than the flat portions 19*e* of the rotational axis 19*d* abut against the holding member 60). As a result, it is impossible to apply a rotational load so that the opened shutter members are moved in any direction.

Further, it is also necessary to consider the case where the phase of the rotational axis 19*d* is out of the correctable range by rotating the driving force relay portion 19 accidentally by the user during the mounting of the toner cartridge 31 as shown in FIG. 13(*b*) and FIG. 14(*c*).

In this embodiment, the idler gear 19*a* of the driving force relay portion 19 is provided with a rib-shaped gear-side abutting portion 19*f*, and the toner container 31*a* of the toner cartridge 31 is provided with a projection-shaped container-side abutting portion 29. The gear-side abutting portion 19*f* is disposed at a position at which it is at least eccentrically disposed with respect to the rotational axis of the idler gear 19*a*. When the toner cartridge 31 is inserted, the container-side abutting portion 29 abuts against a side surface of the gear-side abutting portion 19*f* so that the idler gear 19*a*, and by extension to the driving force relay portion 19 as a whole, is rotated. Incidentally, the rotation by the gear-side abutting portion 19*f* and the container-side abutting portion 29 is held at an accurate phase by the above-described gear return means when the driving force relay 19 is rotated in the correctable range, so that it is not necessary to strictly control an angle after the rotation.

Also on the handle 36 side, it is necessary to ensure that the handle 36 is in the initial position with reliability. Outside the image forming apparatus, the initial position of the handle 36 is determined by holding the handle lock 38 in the handle lock receiving portion 33. However, it should be prevent a deviation in phase with reliability in a period from release of the handle lock 38 to engagement of the driving force transmitting portion 40 with the idler gear 19*a* during the mounting of the toner cartridge 31 into the main assembly.

In this embodiment, as shown in FIG. 4(*a*), at a side surface of the handle 36, a portion 50 to be guided is provided, and as shown in FIG. 7(*a*), a guide portion 51 is provided at a side surface of the toner supply apparatus frame 55 on the apparatus main assembly side. The guide portion 51 is located at a position at which the handle 36 starts to guide the portion 50 to be guided in such a state (initial position) that the handle 36 is held by the handle lock 38, so that the rotational movement of the handle 36 is prevented by wall surfaces at both sides thereof in the insertion direction. When the handle lock 38 is released, the release rib of the main assembly is pressed against the handle lock 38, so that a rotational force is generated in the handle 36. However, the rotation of the handle 36 can be prevented with reliability by the above-described constitution. Further, the guide portion 51 is constituted so as not to block the rotational movement of the handle 36 by setting its position so that the position does not abut the portion 50 to be guided in such a state that the toner cartridge 31 is completed mounted.

By the above described constitutions, it is possible to always locate not only the driving force relay portion 19 but also the handle 36 at their initial positions when the toner cartridge 31 is inserted. Accordingly, the driving force transmitting portion 40 of the handle 36 and the idler gear 19*a* of the driving force relay portion 19 can be engaged with each other always at the same phase (addendum). Further, the container shutter 32 is held at the initial position by the shutter lock 46, so that the driving force transmission receiving portion 32*a* of the container shutter 32 and the large stepped gear 19*c* can be engaged with each other always at the same phase. Further, the apparatus shutter 52 is engaged with the engaging boss 45 of the container shutter 32 held at the initial position through the engaging hole 52*b*, thus being located at its initial position.

Accordingly, the positional relationship among the handle 36, the container shutter 32, and the apparatus shutter 52 can be kept constant, so that the shutter members can be rotationally moved at a predetermined angle within a rotatable range of the handle 36. In other words, the toner cartridge 31 is not accidentally removed from the main assembly in such a state that the apparatus shutter 52 is not sufficiently closed by the restricted rotational movement of the handle 36 and remains open. Further, it is possible to prevent such a defect that the apparatus shutter 52 runs against its closing portion and cannot be rotationally moved before the handle 36 is rotationally moved in a predetermined amount, and thus the toner cartridge 31 cannot be removed. Further, even when the mounting and demounting of the toner cartridge 31 are repeated, the apparatus shutter 52 is always kept at the initial position, so that it is possible to prevent accumulation of deviation of the apparatus shutter 52.

As described hereinabove, according to the present invention, it is possible to provide a developer supply container capable of supplying powdery developer to an electrophotographic image forming apparatus for forming an image with developer and capable of being utilized in the image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 328681/2004 filed Nov. 12, 2004, which is hereby incorporated by reference.

What is claimed is:

1. An image forming apparatus, to which a developer supply container is detachably mountable, capable of supplying a developer to a portion to be supplied with the developer of a main assembly of the image forming apparatus by performing transmission of a driving force between a mounted developer supply container and the main assembly of the image forming apparatus, the image forming apparatus comprising:

a developer receiving opening to be disposed at a position opposite of a developer discharge opening of the mounted developer supply container;

a relay gear train for receiving a driving force from a first transmitting portion, provided to an operation member of the mounted developer supply container for transmitting the driving force for opening and closing a developer supply opening, and for transmitting the driving force to a second transmitting portion, provided to the mounted developer supply container, for transmitting the driving force; and an apparatus shutter member for receiving the driving force from the second transmitting portion to open and close said developer receiving opening, wherein said relay gear train comprises a plurality of gears which have a common rotational axis and are different in number of teeth, wherein one of said plurality of gears of said relay gear train is provided with a gear side abutting portion for abutting against a container side abutting portion provided on the developer supply container when the developer supply container is mounted into the image forming apparatus main assembly, and wherein the container side abutting portion abuts against said gear side abutting portion to rotate said relay gear train when the developer supply container is mounted into the image forming apparatus main assembly.

2. An apparatus according to claim 1, wherein the container side abutting portion abuts against said gear side abutting portion to rotate respective gears of said relay gear train toward their respective initial positions when the developer supply container is mounted into the image forming apparatus main assembly.

3. An apparatus according to claim 1, wherein the developer supply container further includes a lock portion for locking the operation member, and the image forming apparatus further comprises a lock release portion for releasing a locked state of the lock portion when the developer supply container is mounted into the image forming apparatus main assembly.

4. An apparatus according to claim 3, further comprising a guide portion for guiding a portion to be guided provided to the operation member, and said guide portion guides the portion to be guided in a state in which the locked state of the lock portion is released.

5. An apparatus according to claim 4, wherein the portion to be guided begins being guided before the locked state of the lock portion is released and is released from said guide portion before connection of the first transmitting portion with said relay gear train is completed.

6. An apparatus according to claim 1, wherein the developer supply container further includes a container shutter member for opening and closing the developer supply opening, said apparatus shutter member comprises an engaging portion for being engaged with the container shutter member by mounting the developer supply container into the image forming apparatus main assembly, and wherein the container shutter member is capable of being opened and closed in conjunction with said apparatus shutter member and being opened and closed by receiving the driving force from said relay gear train.

7. An apparatus according to claim 1, wherein the developer supply container is mounted into the image forming apparatus main assembly in a direction resistant to a reaction force exerted from said relay gear train on the first transmitting portion during transmission of the driving force.

8. An image forming apparatus, to which a developer supply container is detachably mountable, capable of supplying a developer to a portion to be supplied with the developer of a main assembly of the image forming apparatus by performing transmission of a driving force between a mounted developer supply container and the main assembly of the image forming apparatus, the image forming apparatus comprising:

a developer receiving opening to be disposed opposite of a developer discharge opening of the mounted developer supply container;

a relay gear train for receiving a driving force from a first transmitting portion, provided to an operation member of the mounted developer supply container for transmitting the driving force for opening and closing a developer supply opening, and for transmitting the driving force to a second transmitting portion, provided to the mounted developer supply container, for transmitting the driving force;

an apparatus shutter member for receiving the driving force from the second transmitting portion to open and close said developer receiving opening, wherein said relay gear train comprises at least a plurality of gears which have a common rotational axis and are different in number of teeth; and a gear return mechanism for returning said plurality of gears to their initial positions when the developer supply container is not mounted into the image forming apparatus main assembly.

9. An apparatus according to claim 8, wherein said gear return mechanism comprises a flat portion provided to the rotational axis of said plurality of gears and a holding member which is urged against said flat portion.

10. An apparatus according to claim 8, wherein one of said plurality of gears of said relay gear train is provided with a gear side abutting portion for rotating said relay gear train by abutting against a container side abutting portion provided on the developer supply container when the developer supply container is mounted into the image forming apparatus main assembly.

11. An apparatus according to claim 8, wherein the developer supply container is mounted into the image forming apparatus main assembly in a direction resistant to a reaction force exerted from said relay gear train on the first transmitting portion during transmission of the driving force.

* * * * *